US007561827B2

(12) United States Patent
Shiraki et al.

(10) Patent No.: US 7,561,827 B2
(45) Date of Patent: Jul. 14, 2009

(54) DEVELOPING CARTRIDGE HAVING A HANDLE THAT CONTACTS AN EXPOSURE UNIT WHEN INSTALLED IN AN IMAGE FORMING APPARATUS

(75) Inventors: Masatoshi Shiraki, Nisshin (JP); Fumikazu Sato, Kounan (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 125 days.

(21) Appl. No.: 11/688,470

(22) Filed: Mar. 20, 2007

(65) Prior Publication Data

US 2007/0217818 A1 Sep. 20, 2007

(30) Foreign Application Priority Data

Mar. 20, 2006 (JP) ..... 2006-077268

(51) Int. Cl.
*G03G 15/04* (2006.01)

(52) U.S. Cl. ..... 399/119; 399/111; 399/113

(58) Field of Classification Search ..... 399/111, 399/113, 119; *G03G 21/18*
See application file for complete search history.

(56) References Cited

U.S. PATENT DOCUMENTS 5,300,979 A 4/1994 Tsukakoshi et al.
6,708,011 B2 3/2004 Nomura et al.
2003/0053819 A1* 3/2003 Nomura et al. ..... 399/110
2004/0062566 A1 4/2004 Kato et al.
2006/0029421 A1* 2/2006 Ishii et al. ..... 399/111

FOREIGN PATENT DOCUMENTS

EP 1742117 A1 1/2007
EP 1804136 A1 7/2007
EP 1804141 A1 7/2007
JP 2003-015378 A 1/2003

OTHER PUBLICATIONS

EP Search Report dtd Jul. 12, 2007, EP Appln. 07005651.0.

* cited by examiner

*Primary Examiner*—David M Gray
*Assistant Examiner*—Billy J Lactaoen
(74) *Attorney, Agent, or Firm*—Banner & Witcoff, Ltd.

(57) ABSTRACT

An image forming apparatus includes a housing, an image carrier unit configured to move along a first direction between a first position and a second position in the housing and to hold image carriers, developing cartridges configured to be removably mounted in the image carrier unit, and an exposure unit disposed in the housing and for generating light to irradiate each image carrier. Each developing cartridge includes a developer carrier for supplying developer to the image carrier, a case configured to contain the developer and having a support portion for supporting the developer carrier at a first side of the case and a pair of sidewalls facing each other in a second direction perpendicular to the first direction, and an urging mechanism disposed at a second side of the case opposite to the first side for contacting the exposure unit when the image carrier unit is in the first position.

28 Claims, 24 Drawing Sheets

DEVELOPING CARTRIDGE HAVING A HANDLE THAT CONTACTS AN EXPOSURE UNIT WHEN INSTALLED IN AN IMAGE FORMING APPARATUS

CROSS REFERENCE TO RELATED APPLICATION

This application claims priority from Japanese Patent Application No. 2006-077268, filed on Mar. 20, 2006, the entire subject matter of which is incorporated herein by reference.

FIELD

Aspects of the invention relate to an image forming apparatus, such as a laser printer and a developing cartridge for use in the image forming apparatus.

BACKGROUND

A known tandem image forming apparatus is provided with image carriers in correspondence with yellow, magenta, cyan and black toner. Such a tandem image forming apparatus can print in color at substantially the same speed as printing in monochrome, because a toner image of each color is formed at substantially the same time on each corresponding one of the image carriers and each of the different colored images is sequentially laid on top of a sheet while the sheet passes through the image carriers.

As disclosed in U.S. Pat. No. 6,708,011, a tandem image forming apparatus includes an image carrier cartridge for integrally supporting image carriers, each associated with one color. The image carrier cartridge is slidably installed in or removed from a housing of the image forming apparatus. A developing cartridge for developing an electrostatic latent image formed on each of the image carriers is removably set in the image carrier cartridge.

The developing cartridge includes a developing roller for supplying toner to the image carrier. To properly transfer the toner from the developing roller to the image carrier, the developing roller has to be pressed against the image carrier at an appropriate pressure. To properly press the developing roller against the image carrier, an elastic member, such as a spring, is provided in the housing of the image forming apparatus. The developing roller is urged by the elastic member to press the developing roller against the image carrier.

However, elasticity of the elastic member will gradually decrease as the elastic member deteriorates. Accordingly, the pressing force of the developing roller against the image carrier decreases, leading to toner supply shortage. The toner supply shortage may cause development failure.

SUMMARY

Aspects of the invention provide a developing cartridge in which a developer carrier may be pressed against an image carrier, and an image forming apparatus for use with the developing cartridge.

In an illustrative aspect, an image forming apparatus includes a housing, an image carrier unit configured to move along a first direction between a first position and a second position in the housing and to hold image carriers, developing cartridges configured to be removably mounted in the image carrier unit, and an exposure unit disposed in the housing and for generating light to irradiate each image carrier. Each developing cartridge includes a developer carrier for supplying developer to the image carrier, a case configured to contain the developer and having a support portion for supporting the developer carrier at a first side of the case and a pair of sidewalls facing each other in a second direction perpendicular to the first direction, and a handle disposed at a second side of the case opposite to the first side for contacting the exposure unit when the image carrier unit is in the first position.

BRIEF DESCRIPTION OF THE DRAWINGS

Aspects of the invention will be described in detail with reference to the following figures in which like elements are labeled with like numbers and in which.

DETAILED DESCRIPTION

Aspects of the invention will be described in detail below with reference to the accompanying drawings.

Figure 1:
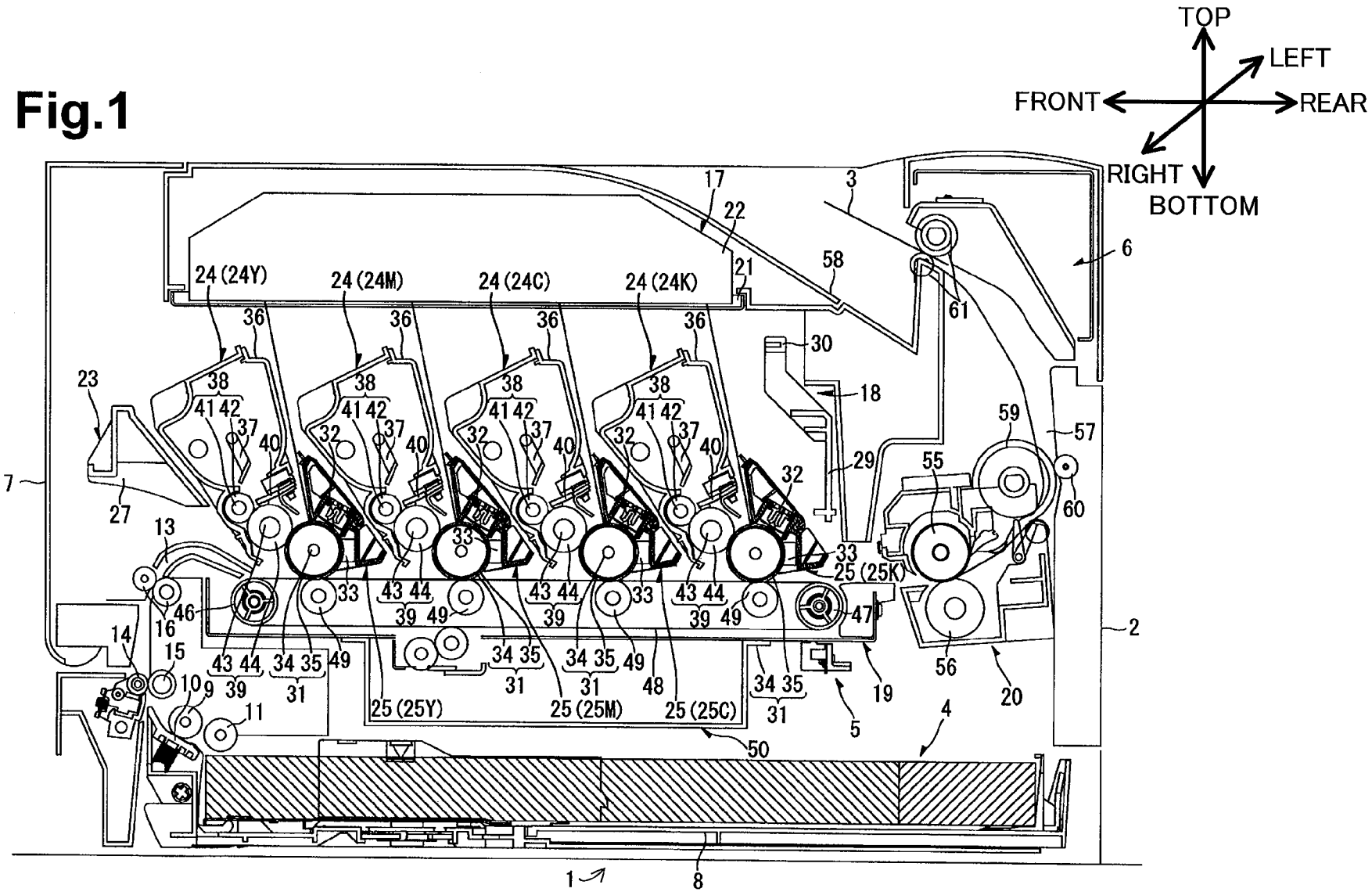
FIG. 1 is a sectional side view showing a general structure of a color laser printer as an image forming apparatus according to an aspect of the invention.

As shown in FIG. 1, a color laser printer 1 is a tandem color laser printer in which sub units 25 are arranged in tandem in a horizontal direction in correspondence with yellow, magenta, cyan and black toner.

The color laser printer 1 includes a housing 2, a sheet supply section 4 that supplies a sheet 3, an image forming section 5 that forms an image on the sheet 3 fed therein, and a sheet ejection section 6 that ejects the sheet 3 on which the image is formed. The sections 4, 5, 6 are disposed in the housing 2.

In the following description, the left side in FIG. 1 is referred to as the front side of the printer 1 and an opposite side (the right side in FIG. 1) is referred to as the rear side of the printer 1 as shown by the arrows in FIG. 1. The right and left sides of the printer 1 are defined when the printer 1 is viewed from the front side. Unless otherwise specified, the front, rear, left, right, top and bottom of a drum unit 23 and a developing cartridge 24 are defined in conjunction with an orientation in which the drum unit 23 and the developing cartridge 24 are installed in the housing 2.

At the front wall of the housing 2, a front cover 7 is disposed to cover or uncover a space in the housing 2. The front cover 7 is pivotally supported about a lower end thereof by the front wall of the housing 2. With the front cover 7 open, a process unit 18 can be withdrawn from the housing 2 to a withdrawal position and inserted into an installation position.

Figure 9:
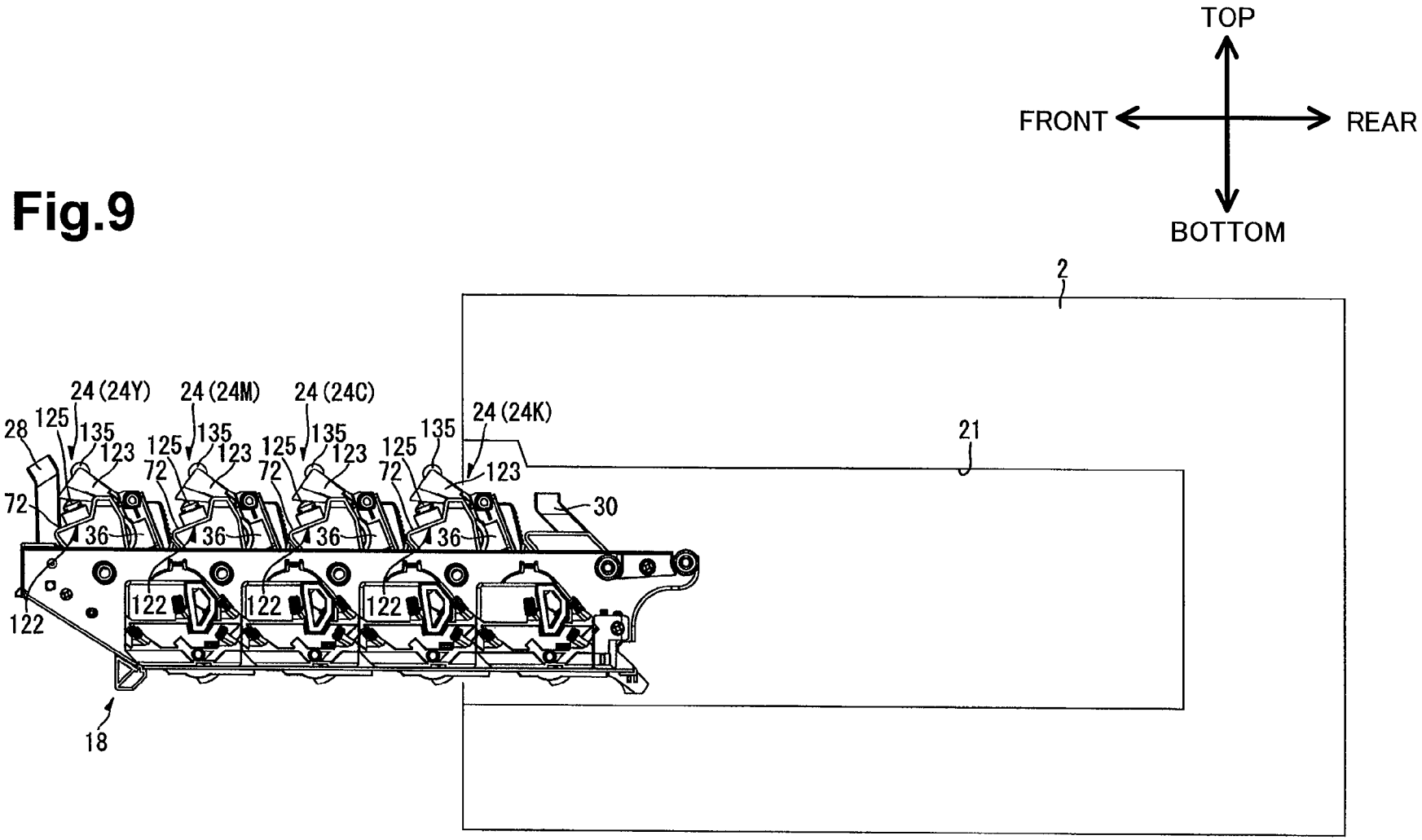
FIG. 9 is a right side view of a housing of the color laser printer and the process unit shown in FIG. 1, illustrating the process unit being withdrawn from the housing.
Figure 10:
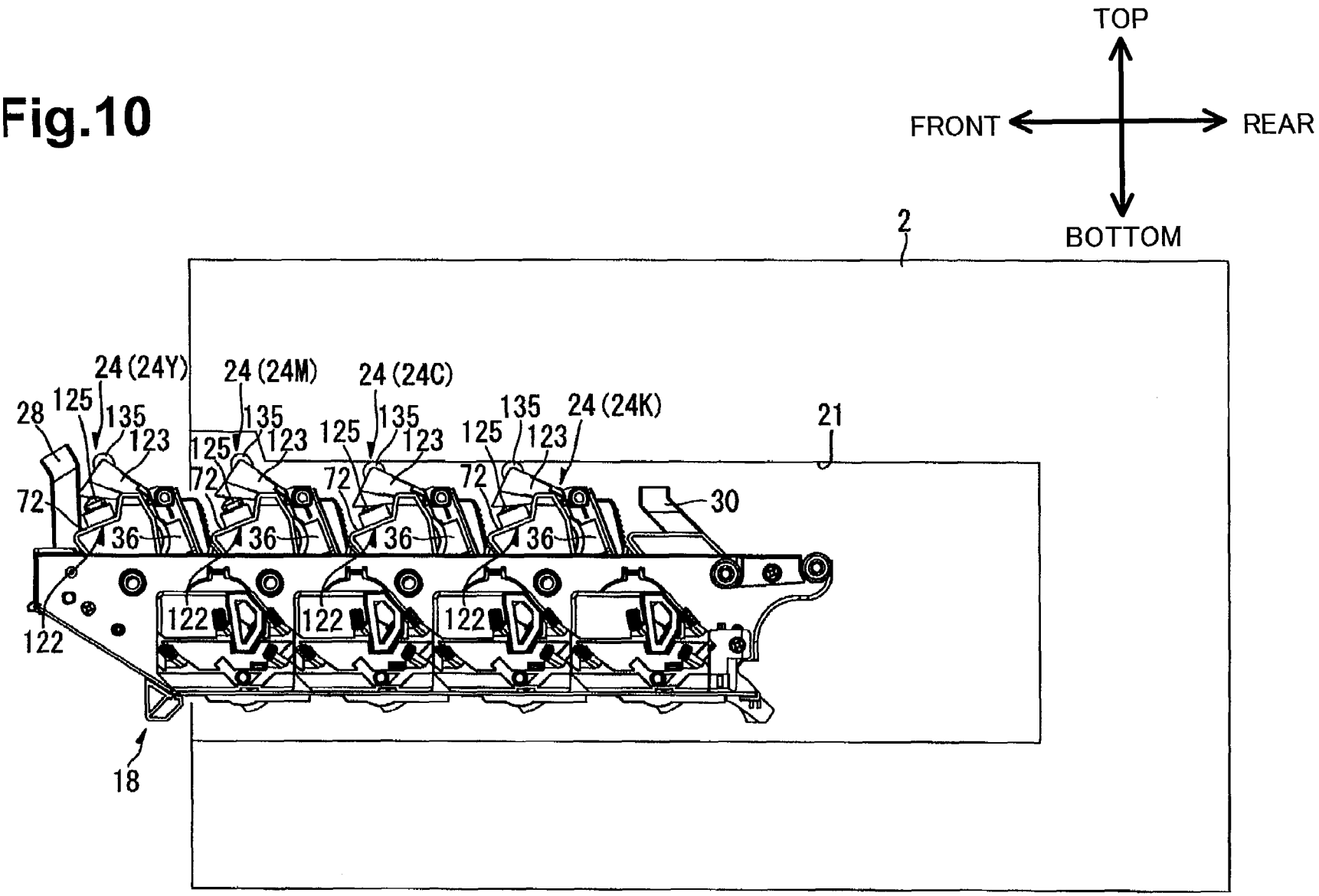
FIG. 10 is a right side view of the housing and the process unit shown in FIG. 1, illustrating the process unit being inserted into the housing.
Figure 11:
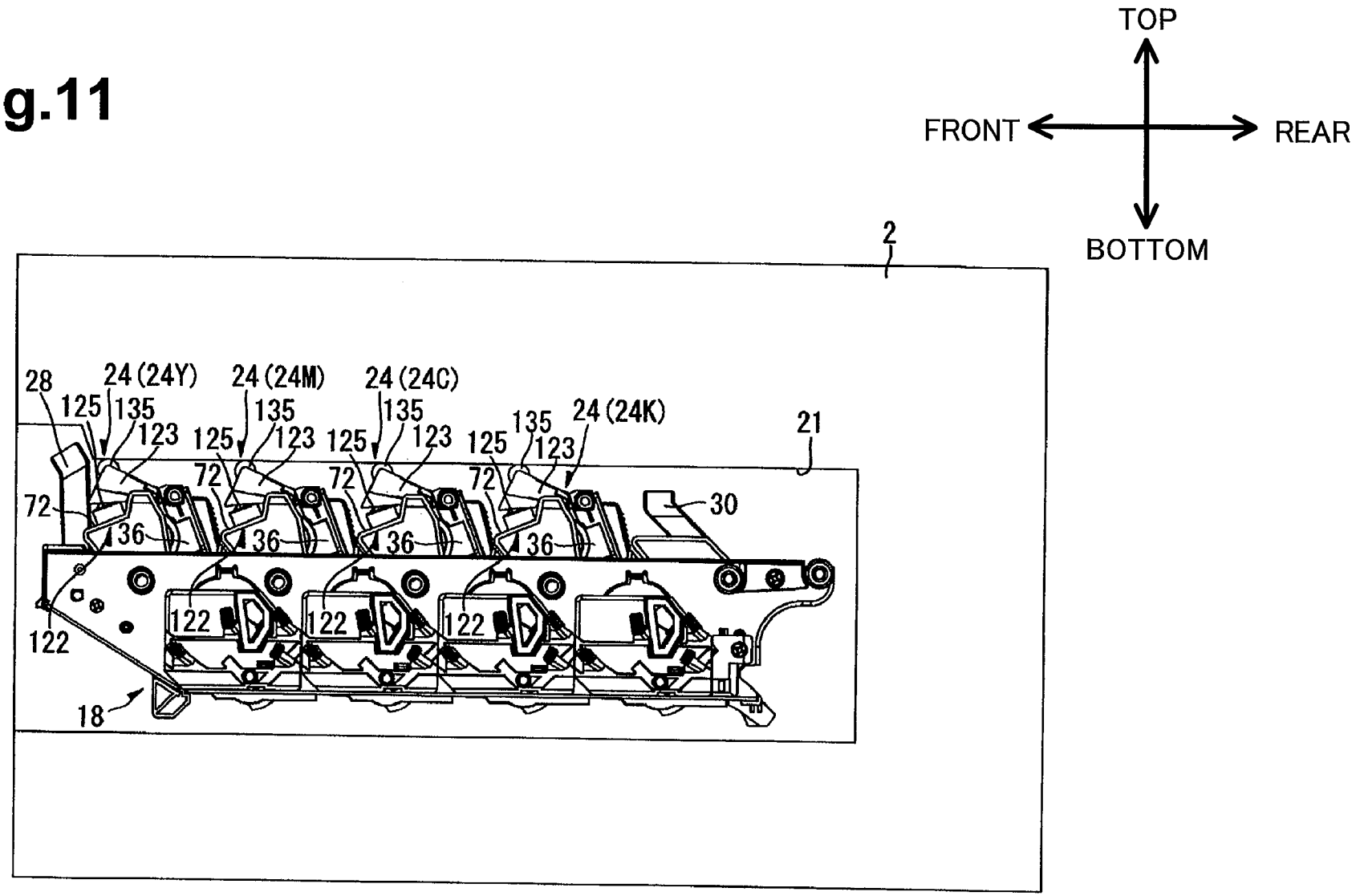
FIG. 11 is a right side view of the housing and the process unit shown in FIG. 1, illustrating the process unit being installed in the housing.

As shown in FIGS. 1 and 11, the installation position refers to a position where the process unit 18 is placed during an image formation operation. As shown in FIGS. 9 and 10, the withdrawal position refers to a position where the process unit 18 is fully withdrawn or is in the process of being withdrawn through the front cover 7. In the withdrawal position, a pressing member 123 of at least one of developing cartridges 24 is out of contact with a bottom surface of a supporting plate 21 of an exposure unit 17 (described below).

The sheet supply section 4 is provided at a bottom portion of the housing 2. The sheet supply section 4 is inserted in or removed from the housing 2 while being slidably moved along the front-rear direction. The sheet supply section 4 includes a sheet supply tray 8, a separation roller 9, a separation pad 10, a pickup roller 11, and a sheet supply path 13. The sheet supply tray 8 holds sheets 3 therein. The separation roller 9 and the separation pad 10 oppose each other at the upper front end of the sheet supply tray 8 when the sheet supply tray 8 is installed in the housing 2. The pickup roller 11 is disposed at the top front end of the sheet supply tray 8 to pick up each sheet 3 and transfer the sheet 3 to the separation roller 9. The sheets 3 are fed along the sheet supply path 13.

A sheet dust removing roller 14 and a pinch roller 15 opposing each other are disposed in front of and above the separation roller 9 in the sheet supply path 13. A pair of register rollers 16 is disposed above the sheet dust removing roller 14 and the pinch roller 15.

The image forming section 5 includes an exposure unit 17, a process unit 18, a transfer unit 19, and a fixing unit 20.

The exposure unit 17 is disposed at an upper portion of the housing 2. The exposure unit 17 includes a support plate 21 extending in the front-rear and right-left directions above the process unit 18 placed in the installation position, and a casing 22 supported on the upper surface of the support plate 21. A laser beam emitting portion and a polygon mirror are disposed in the casing 22.

The exposure unit 17 emits from the laser beam emitting portion a laser beam corresponding to image data for each yellow, magenta, cyan, and black color. The laser beam is scanned by the polygon mirror. The laser beam passes through a beam passing window 137 (FIG. 13) formed in the support plate 21 to irradiate surfaces of photosensitive drums 31 (described below).

The process unit 18 includes a drum unit 23 as an example of an image carrier unit, and four developing cartridges 24 for each color.

Figure 2:
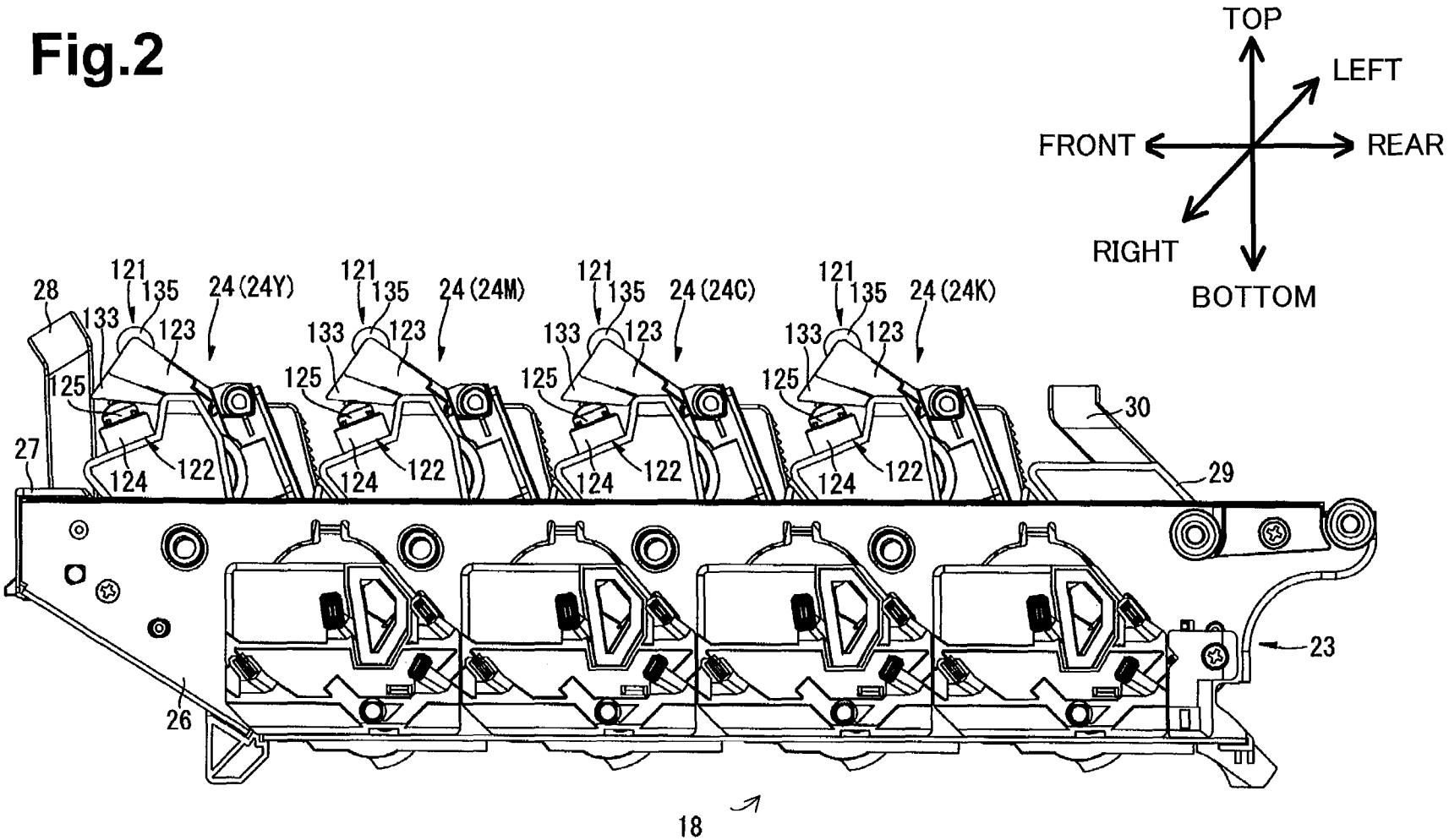
FIG. 2 is a right-side view of a process unit shown in FIG. 1.

Referring to FIGS. 1 and 2, the drum unit 23 will be described. The drum unit 23 includes four sub units 25, each corresponding to one color, a pair of side plates 26 sandwich the four drum units 25 from the right and left sides (FIG. 2 only showing right side plate 26), a front beam 27 disposed between the front ends of the side plates 26, a front holding portion 28 disposed at the front beam 27, a rear beam 29 disposed between the rear ends of the side plates 26, and a rear holding portion 30 disposed at the rear beam 29.

As shown in FIG. 1, the sub units 25 include a yellow sub unit 25Y, a magenta sub unit 25M, a cyan sub unit 25C and a black sub unit 25K that are arranged respectively from the front side along the front-rear direction with some distance between adjacent sub units 25.

Each sub unit 25 holds a photosensitive drum 31, as an example of an image carrier, a scorotron charger 32, and a cleaning brush 33.

The photosensitive drum 31 is of cylindrical shape and is rotatable. The photosensitive drum 31 includes a drum shaft 34 that extends in the left and right direction and a drum body 35 rotatable on the drum shaft 34. The surface of the photosensitive drum 31 is uniformly and positively charged by the charger 32 during an image formation operation. The cleaning brush 33 is disposed to remove paper dust or fibers left on the photosensitive drum 31 after image transfer to the sheet 3. The cleaning brush 33 is disposed behind the photosensitive drum 31.

The four developing cartridges 24 are configured to be detachably mounted in the corresponding sub units 25 provided for each color, as shown in FIG. 1. More specifically, the developing cartridges 24 include a yellow developing cartridge 24Y detachably mountable in the yellow sub unit 25Y, a magenta developing cartridge 24M detachably mountable in the magenta sub unit 25M, a cyan developing cartridge 24C detachably mountable in the cyan sub unit 25C, and a black developing cartridge 24K detachably mountable in the black sub unit 25K.

Each developing cartridge 24 includes a box-shaped case 36 with an opening at its lower end. Each developing cartridge 24 further includes an agitator 37, a supply roller 38, a developing roller 39, as an example of a developer carrier, and a layer thickness regulating blade 40 that are disposed in the case 36.

Toner as a developer is contained in the case 36. More specifically, the yellow developing cartridge 24Y contains yellow toner, the magenta developing cartridge 24M contains magenta toner, the cyan developing cartridge 24C contains cyan toner, and the black developing cartridge 24K contains black toner. Each developing cartridge 24 contains, for example, positively chargeable non-magnetic single component polymerized toner.

The agitator 37 agitates the toner in the case 36. The supply roller 38 includes a metal supply roller shaft 41 rotatably supported by the case 36 and a conductive sponge roller 42 covering a peripheral surface of the supply roller shaft 41. The developing roller 39 includes a metal developing roller shaft 43 rotatably supported by the case 36 and a conductive rubber roller 44 covering a peripheral surface of the developing roller shaft 43. The layer thickness regulating blade 40 is supported by the case 36 at its end opposite to the free end of the blade 40.

The toner contained in the case 36 of each developing cartridge 24 is supplied by gravity to the supply roller 38 while being agitated by the agitator 37. The toner supplied to the supply roller 38 is then supplied to the developing roller 39 while the supply roller 38 is rotating. At this time, the toner is positively charged by friction between the developing roller 39 to which developing bias is applied and the supply roller 38. The toner supplied to the developing roller 39 passes between the blade 40 and the developing roller 39 while the developing roller 39 is rotating. The toner is carried on the surface of the developing roller 39 as a thin layer whose thickness has been uniformly regulated.

In the sub unit 25, the surface of the photosensitive drum 31 is uniformly and positively charged by the corresponding charger 32 while the drum 31 is rotating. The positively-charged drum 31 surface is selectively exposed to the laser beam emitted from the exposure unit 17 at high speed to form on the surface of the drum 31 an electrostatic latent image corresponding to an image to be formed on the sheet 3.

As the toner, which is carried on the developing roller 39 and is positively charged, is brought into contact with the corresponding photosensitive drum 31 by the rotation of the developing roller 39 while the drum 31 is rotated, the toner is supplied to the electrostatic latent image formed on the surface of the photosensitive drum 31. Thus, the electrostatic latent image on the drum 31 is made visible and a toner image of each color is formed on the relevant photosensitive drums 31.

The transfer unit 19 is disposed above the sheet supply section 4 and below the process unit 18 in the housing 2, along the front-rear direction, as shown in FIG. 1. The transfer unit 19 includes a drive roller 46, a driven roller 47, a conveying belt 48, transfer rollers 49, and a cleaning unit 50.

The sheet 3 supplied from the sheet supply section 4 is fed from the front side to the rear side by the conveying belt 48 circulated by the drive roller 46 and the driven roller 47, so as to sequentially pass through transfer positions between the conveying belt 48 and the photosensitive drums 31. The color toner images carried on the photoconductive drums 31 are transferred onto the sheet 3 while the sheet 3 passes between the transfer positions. Thus, a color image is formed on the sheet 3.

More specifically, as the yellow toner image carried on the surface of the photoconductive drum 31 of the yellow sub unit 25Y is transferred on the sheet 3, the magenta toner image carried on the surface of the photoconductive drum 31 of the magenta process units 25M is then transferred on the sheet 3 having the yellow toner image transferred thereon. Similarly, the cyan and black toner images carried on the surfaces of the photoconductive drums 31 of the cyan and black process units 25C, 25K, respectively, are transferred on the sheet 3. Thus, each of the different colored images is laid on top of each other.

The fixing unit 20 is disposed behind the black sub unit 25K in the housing 2 to face, in the front-rear direction, the transfer position between the photosensitive drum 31 and the conveying belt 48. The fixing unit 20 includes a heat roller 55 and a pressure roller 56.

The sheet 3 is fed to the fixing unit 20 where the color toner images transferred onto the sheet 3 are thermally fixed while the sheet 3 passes between the heat roller 55 and the pressure roller 56. Thus, a color image is formed on the sheet 3. The sheet 3 is then fed by the heat roller 55 and the pressure roller 56 toward the sheet ejection section 6.

In the sheet ejection section 6, the sheet 3 is fed from the fixing unit 20 along a sheet ejection path 57 to a feed roller 59 and a pinch roller 60, and ejected by a pair of ejection rollers 61 onto a sheet ejection tray 58.

The case 36 of each developing cartridge 24 will be described in detail below.

As shown in FIGS. 3-8, the case 36 is integrally provided with a pair of sidewalls 71 facing each other in the left and right direction, a top wall 72 disposed between the sidewalls 71 at their top ends, a front wall 73 disposed between the sidewalls 71 at their front ends, and a rear wall 74 disposed between the sidewalls 71 at their rear ends. The sidewalls 71, the front wall 73, and the rear wall 74 define, at their bottom ends, an opening from which the developing roller 39 is exposed.

Figure 3:
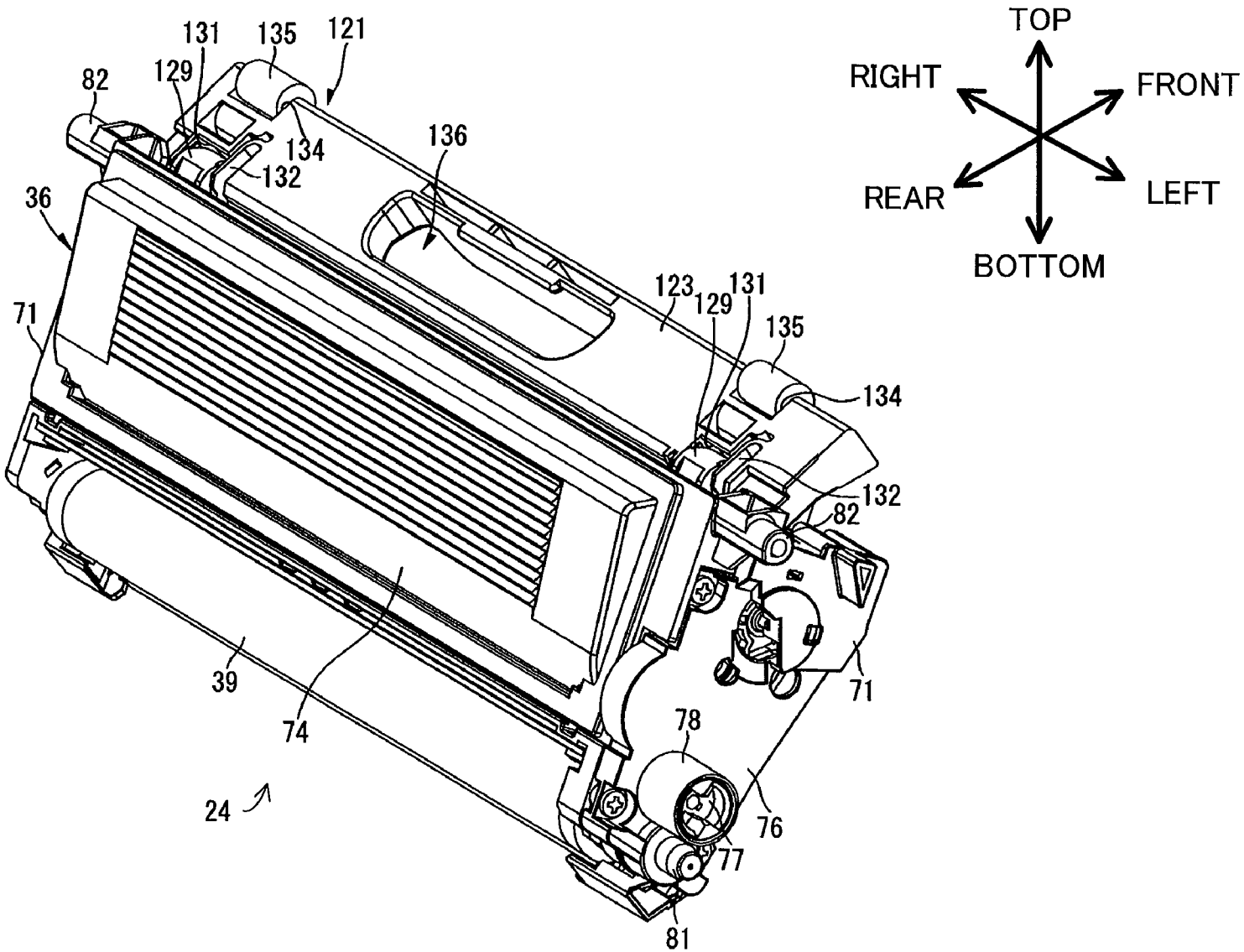
FIG. 3 is a perspective view of a developing cartridge shown in FIG. 2, viewed from a rear left side.
Figure 8:
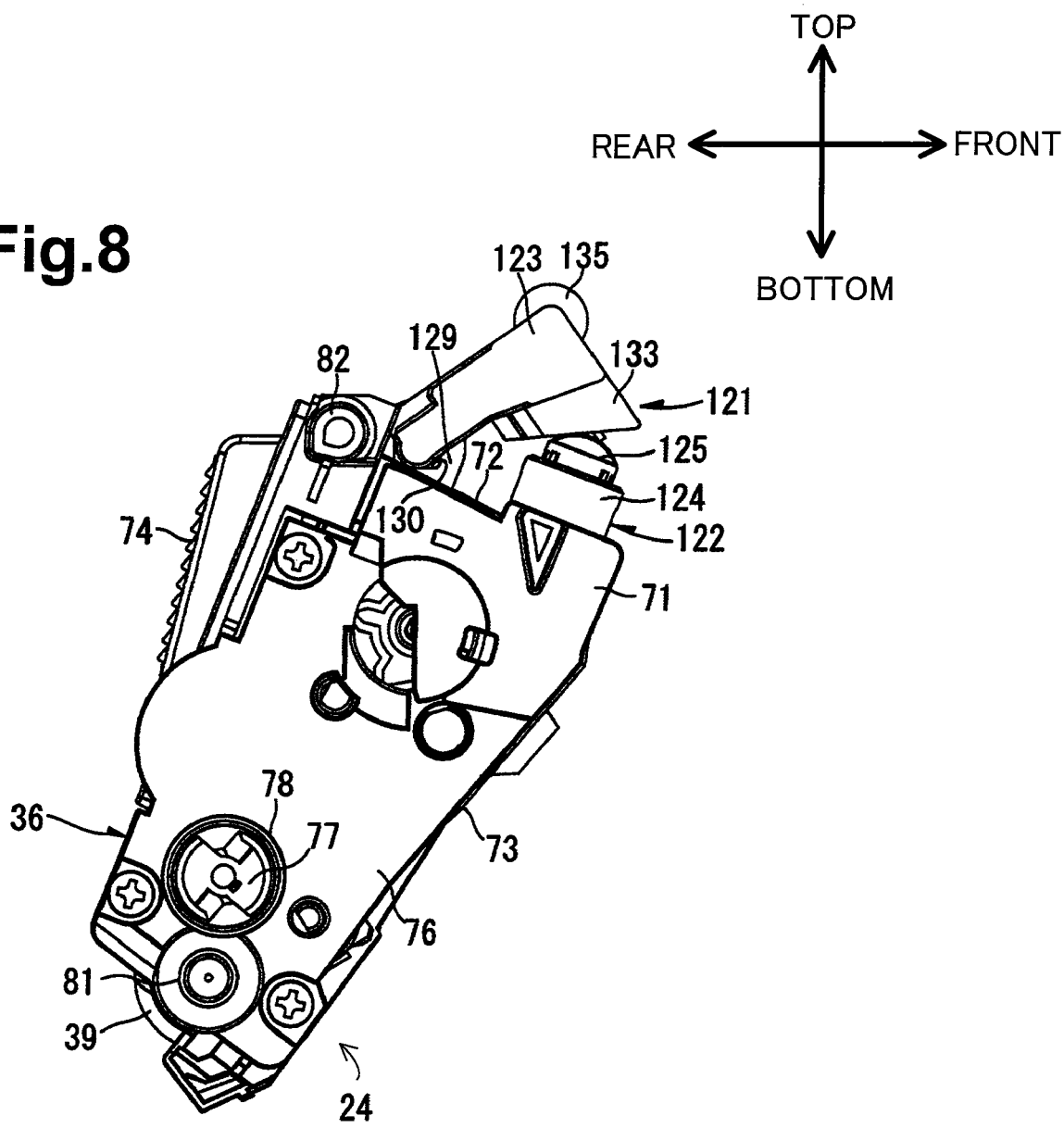
FIG. 8 is a left side view of the developing cartridge shown in FIG. 3.

As shown in FIGS. 3 and 8, the left sidewall 71 is provided with a gear mechanism (not shown) covered with a gear cover 76. The gear mechanism includes a driven coupling gear 77 and a gear train (not shown). Drive force input to the driven coupling gear 77 is transmitted via the gear train to the agitator 37, the supply roller 38, and the developing roller 39. A cylindrical gear positioning portion 78 extends from a lower portion of the gear cover 76 toward the left side. The driven coupling gear 77 is disposed in the gear positioning portion 78.

Figure 4:
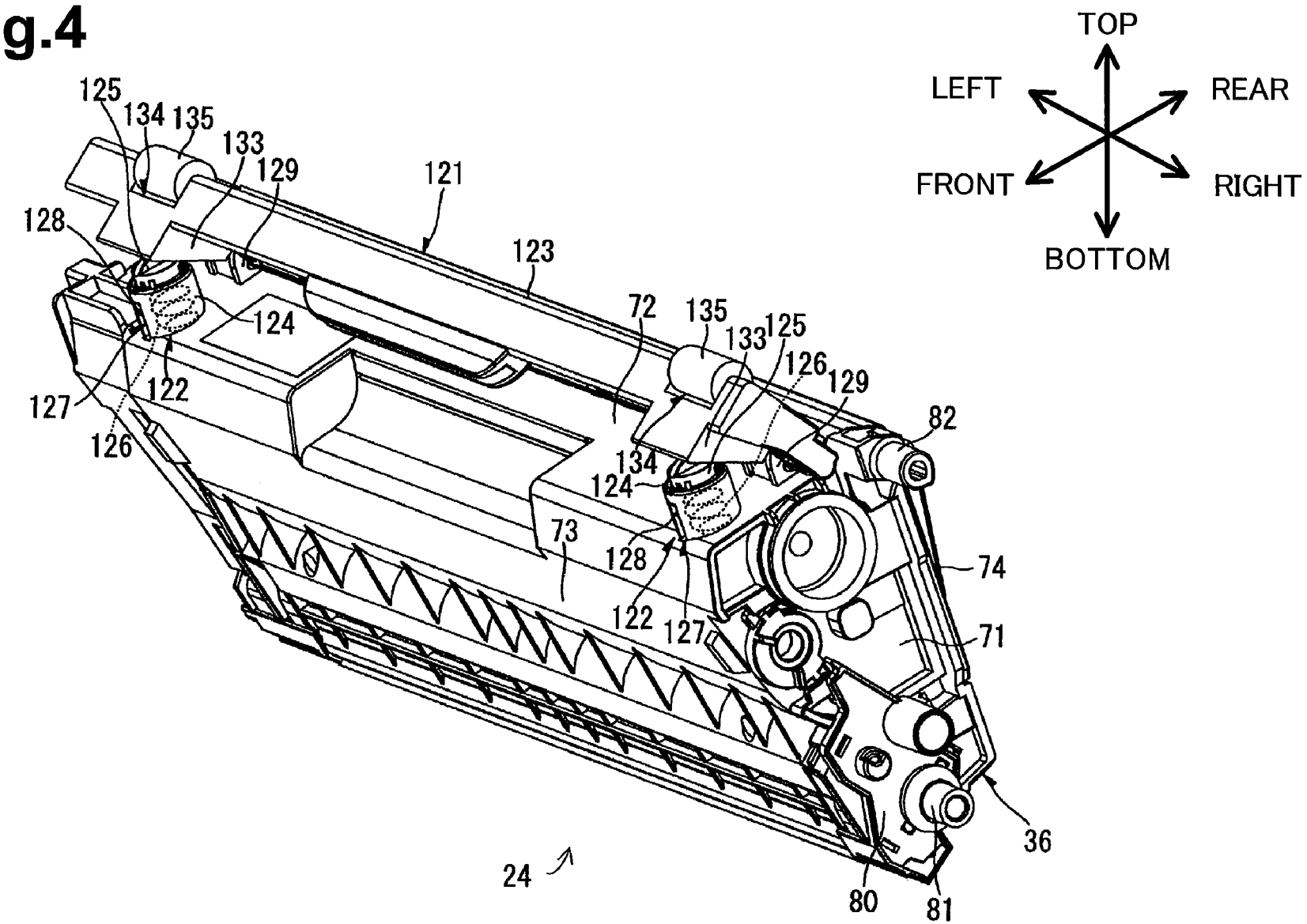
FIG. 4 is a perspective view of the developing cartridge shown in FIG. 3 viewed from a front right side.
Figure 5:
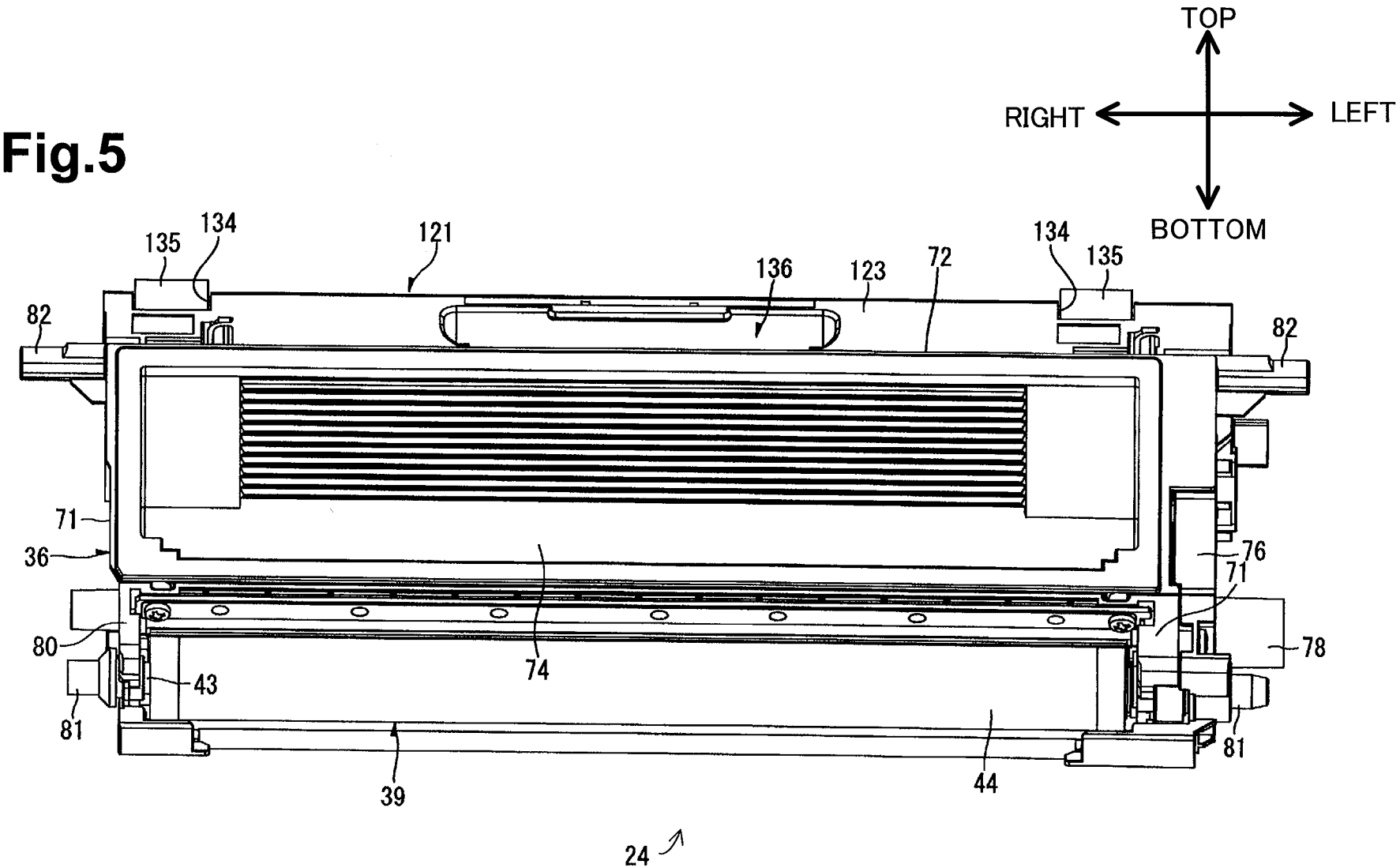
FIG. 5 is a rear side view of the developing cartridge shown in FIG. 3.
Figure 7:
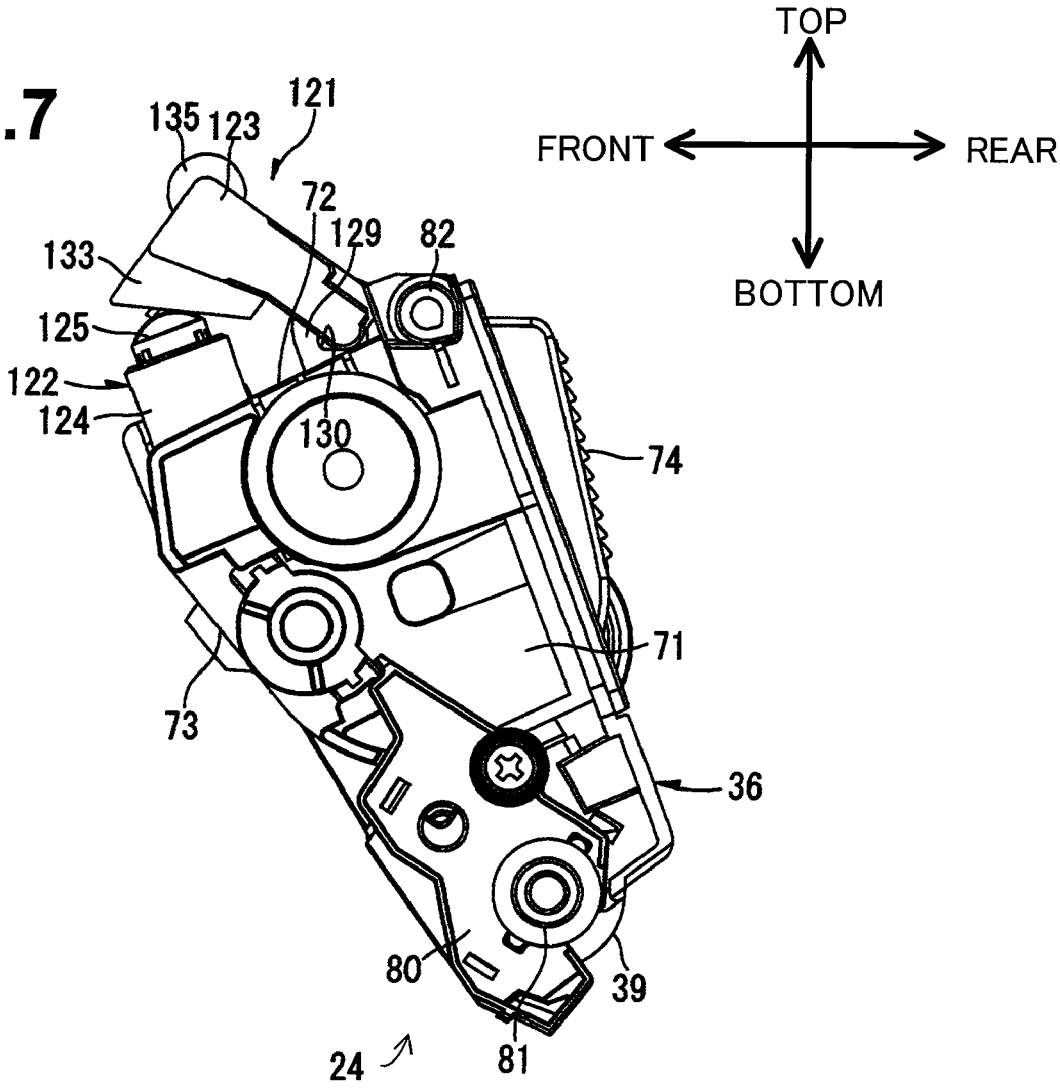
FIG. 7 is a right side view of the developing cartridge shown in FIG. 3.

A bearing member 80 that rotatably supports the right edge of the developing roller shaft 43 is disposed at a lower side of the right sidewall 71, as shown in FIGS. 4 and 7. The right edge of the developing roller shaft 43 is rotatably inserted into a hole formed in the bearing member 80, as shown in FIG. 5. The left edge of the developing roller shaft 43 is rotatably inserted in a hole formed in the left sidewall 71. Thus, the developing roller shaft 43 is rotatably supported by the case 36. The left edge and right edge of the developing roller shaft 43 extend outward from the gear cover 76 and the bearing member 80, respectively. A part of the edge of the shaft 43 extending from the gear cover 76 or the bearing member 80 is covered by a collar member 81, as shown in FIG. 5.

As shown in FIGS. 3-8, a separation projection 82 is provided so as to extend outwardly in the left and right direction from an upper end of each sidewall 71. The separation projection 82 is of a substantially cylindrical shape.

An urging mechanism 121 is provided on the top wall 72. The urging mechanism 121 is configured to urge the developing roller 39 toward the corresponding photosensitive drum 31 when the process unit 18 is in the installation position.

As shown in FIG. 4, the urging mechanism 121 includes two elastic mechanisms 122 and a pressing member 123 configured to press the elastic mechanisms 122 at one time.

Figure 6:
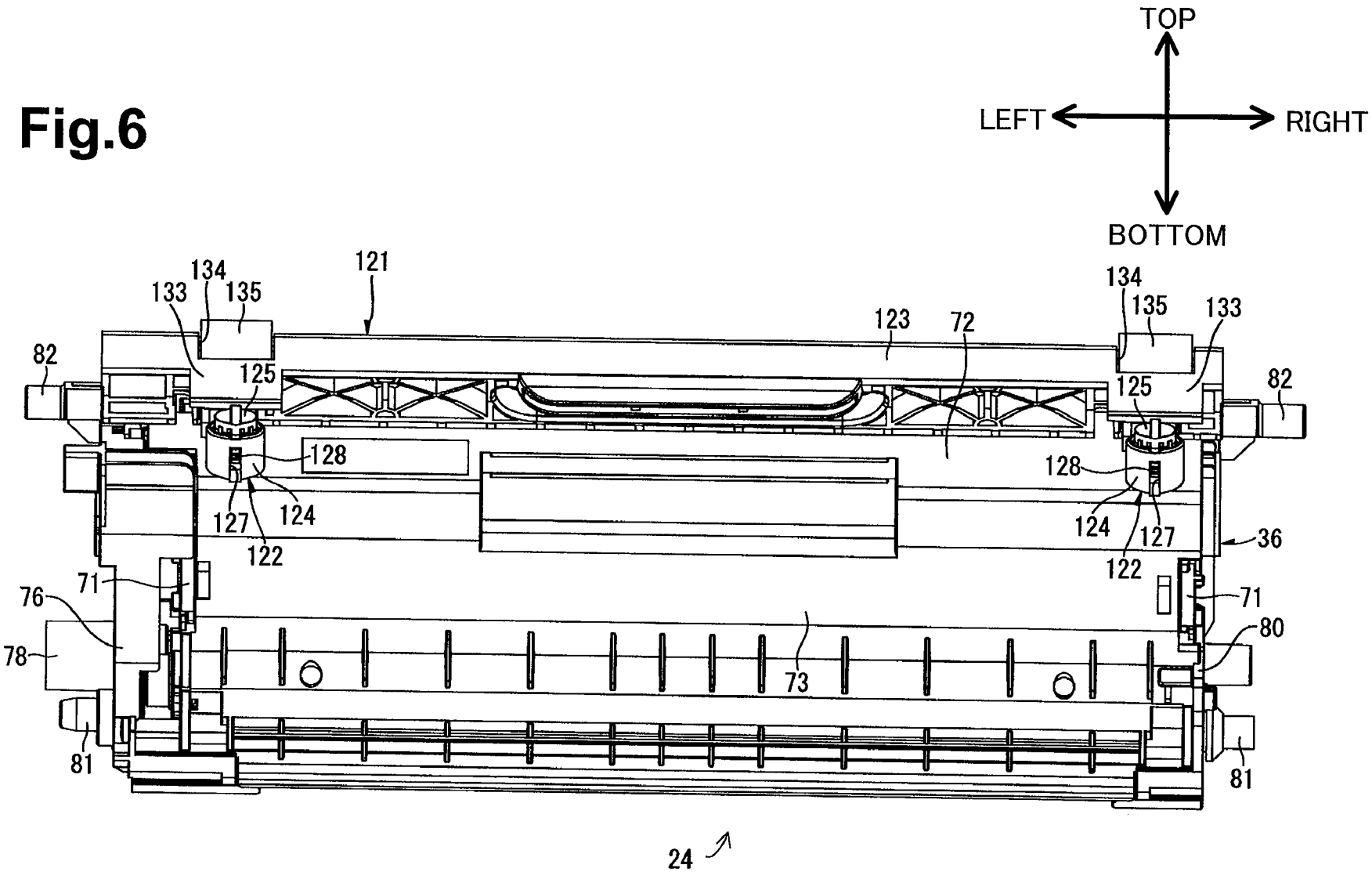
FIG. 6 is a front side view of the developing cartridge shown in FIG. 3.

As shown in FIGS. 4 and 6, the elastic mechanism 122 is disposed near each front right and left edge of the top wall 72. More specifically, the elastic mechanism 122 is disposed with a distance substantially equal to the length of the rubber roller 44 of the developing roller 39 between the elastic mechanisms 122. With such a structure, each elastic mechanism 122 faces an edge of the rubber roller 44 in a direction perpendicular to an axial direction of the rubber roller 44.

As shown in FIG. 4, each elastic mechanism 122 includes a cylindrical spring guide member 124, as an example of a guide member, a contact member 125 configured to move in the vertical direction so as to advance or retract from the upper end of the spring guide member 124, and a coil spring 126, as an example of an elastic member, that is disposed in the spring guide member 124.

Grooves 127 are formed on the peripheral surface of the spring guide member 124. Each groove 127 extends vertically from the lower end of the spring guide member 124 to a portion near the upper end of the spring guide member 124.

The contact member 125 includes hooks 128 that fit in the corresponding grooves 127. As the hooks 128 are stopped by the upper end of the corresponding grooves 127, the contact member 125 is prevented from being separated from the spring guide member 124.

The coil spring 126 is compressed between the top wall 72 and the contact member 125. The coil spring 126 urges the contact member 125 upward.

The pressing member 123 is of a thin plate shape that extends in the left and right direction. The pressing member 123 is pivotally disposed to assume an upright state, a contact state and a pressing state. In the upright state, the pressing member 123 is substantially perpendicular to the top wall 72. In the contact state, the pressing member 123 tilts forward and contacts the contact member 125 of each elastic mechanism 122. In the pressing state, the pressing member 123 tilts more forward than when it is in the contact state and also assumes a position closer to the top wall 72.

More specifically, as shown in FIGS. 3 and 4, pressing member support portions 129 are integrally formed with the top wall 72 at its rear potions so as to face the elastic mechanisms 122 in the front-rear direction. As shown in FIGS. 7 and 8, a support hole 130 is formed on each pressing member support portion 129 so as to pass through in the left and right direction. As shown in FIG. 3, an engagement portion 131 is disposed at rear left and right ends of the pressing member 123. An elastic piece 132, which is shaped into a substantially "L" in plan view, is disposed on a left side surface of each engagement portion 131. A distal end of the elastic piece 132 is connected to the left side surface of the engagement portion 131. A free end of the elastic piece 132 faces the right side surface of the corresponding engagement portion 131 with a space therebetween. A support shaft (not shown) extends from the free end of each elastic piece 132 and the right side surface of the corresponding engagement portion 131 so as to face each other.

As the elastic piece 132 is deformed, the distance between the support shafts expands. In this state, each pressing member support portion 129 is fitted in the space between the free end of the elastic piece 132 and the right side surface of the engagement portion 131. Then, as the deformed elastic piece 132 is restored to its original state, each support shaft is fitted into the corresponding support hole 130. Thus, the pressing member 123 is pivotally attached to the pressing member support portions 129.

As shown in FIGS. 4, 7 and 8, receiving portions 133 are disposed on the front end of the pressing member 123 at positions corresponding to the elastic mechanisms 122. Each receiving portion 133 is of a substantially triangular shape in a side view extending downward from a surface of the pressing member 123 facing the top wall 72. When the pressing member 123 is in the contact state, the receiving portion 133 contacts the corresponding contact member 125.

A roller receiving portion 134 is disposed on the front end of the pressing member 123 near each receiving portion 133 in the moving direction of the pressing member 123. Each roller receiving portion 134 is of a substantially rectangular shape in top and front views. The roller receiving portions 134 are disposed a distance substantially equal to the length of the rubber roller 44 of the developing roller 39 from each other. One roller receiving portion 134 is disposed to face an edge of the rubber roller 44 in the direction perpendicular to the axial direction of the rubber roller 44.

A roller 135 of a substantially cylindrical shape is rotatably disposed in each roller receiving portion 134. Accordingly, the distance between the rollers 135 is substantially the same as the length of the rubber roller 44. The rollers 135 function as friction reduction members when they contact the bottom surface of the support plate 21.

As shown in FIG. 3, an opening 136 is provided in a substantially central portion of the pressing member 123 in the left and right direction. The opening 136 is of a substantially rectangular shape in a plan view that is elongated in the left and right direction. A user may hold the pressing member 123 by inserting his/her fingers into the opening 136.

When a user installs the developing cartridge 24 in the drum unit 23, the user may hold the pressing member 123. The developing cartridge 24 is inserted into the corresponding sub unit 25 such that the developing roller 39 approaches the corresponding photosensitive drum 31. When the developing cartridge 24 is set in the corresponding sub unit 25, the pressing member 123 may tilt due to gravity and be placed in the contact state. When a user takes the developing cartridge 24 out of the drum unit 23, the user can hold the pressing member 123 and pull the developing cartridge 24 upwardly.

Pressing of the developing roller 39 against the corresponding photosensitive drum 31 will be described with reference to FIGS. 9-11.

To place the process unit 18 in the installation position in the housing 2, the process unit 18 is slidably inserted along the front-rear direction from the front side of the housing 2 toward the rear side when the front cover 7 is open.

As shown in FIG. 9, when the process unit 18 is in the withdrawal position, the rollers 135 of the developing cartridges 24 do not contact the bottom surface of the support plate 21 of the exposure unit 17 disposed in the housing 2.

When the process unit 18 is further inserted inward/rearward, as shown in FIG. 10, the rollers 135 of the rearmost black developing cartridge 24K contact the bottom surface of the support plate 21. The bottom surface of the support plate 21 presses the rollers 135 down, so that the pressing member 123 placed in the contact state tilts toward a direction to approach the top wall 72 and presses the contact members 125 down. As the process unit 18 is further inserted inward/rearward, the rollers 135 of the cyan, magenta, and yellow developing cartridges 24C, 24M, 24Y contact the bottom surface of the support plate 21. The pressing member 123 of the developing cartridges 24C, 24M, 24Y presses the relevant contact members 125 down. Thus, the pressing member 123 is placed in the pressing state between the bottom surface of the support plate 21 and the elastic mechanisms 122.

When the process unit 18 is placed in the installation position, as shown in FIG. 11, the pressing members 123 of all the developing cartridges 24 are placed in the pressing state.

As the contact members 125 are pressed, the coil spring 126 is compressed. The restoring force of the compressed coil spring 126 is applied to the top wall 72 of the case 36. Thus, the case 36 is urged downward, so that the developing roller 39 may be pressed against the corresponding photosensitive drum 31.

Figure 12:
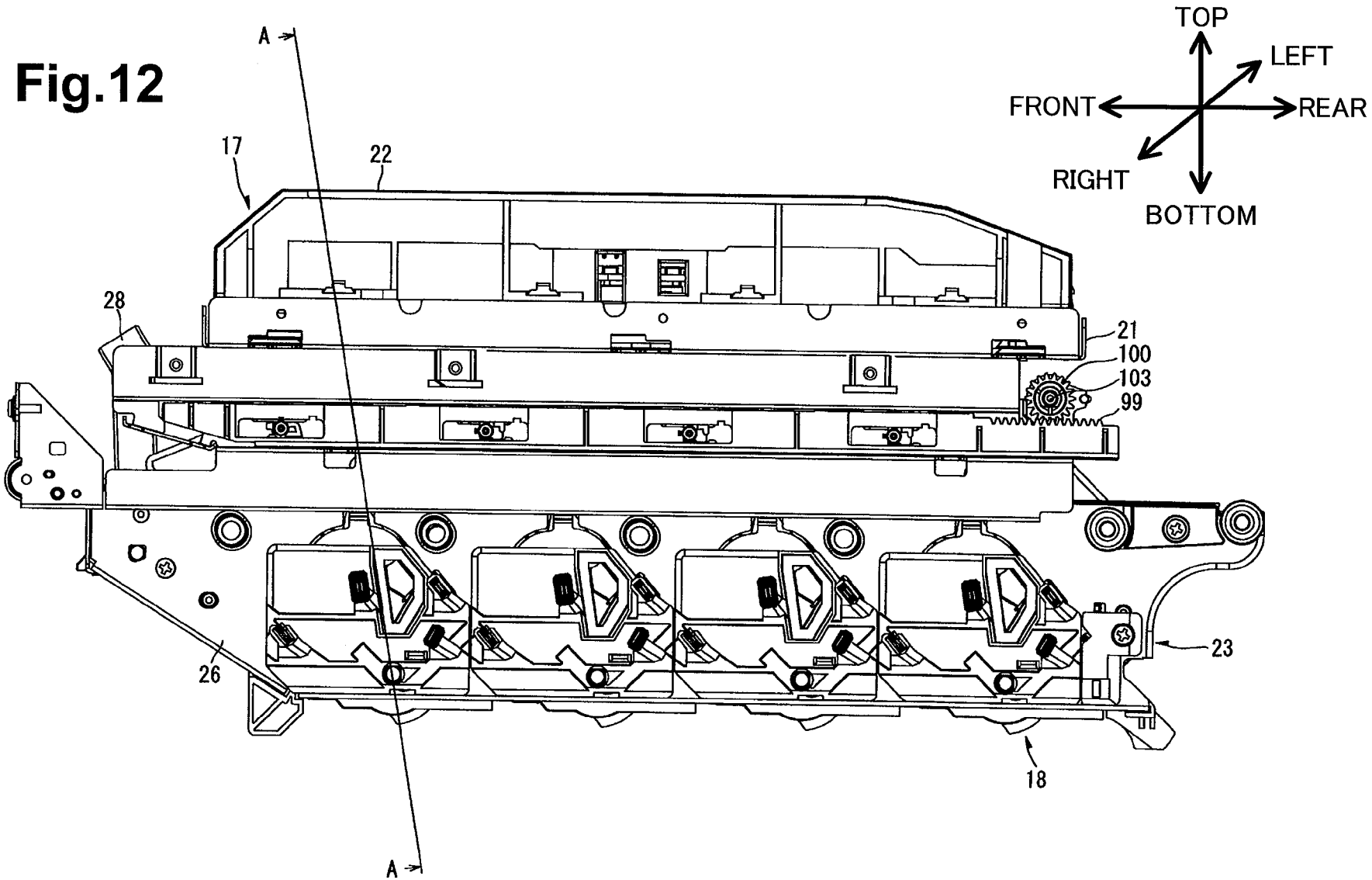
FIG. 12 is a right side view of an exposure unit and the process unit shown in FIG. 1.
Figure 13:
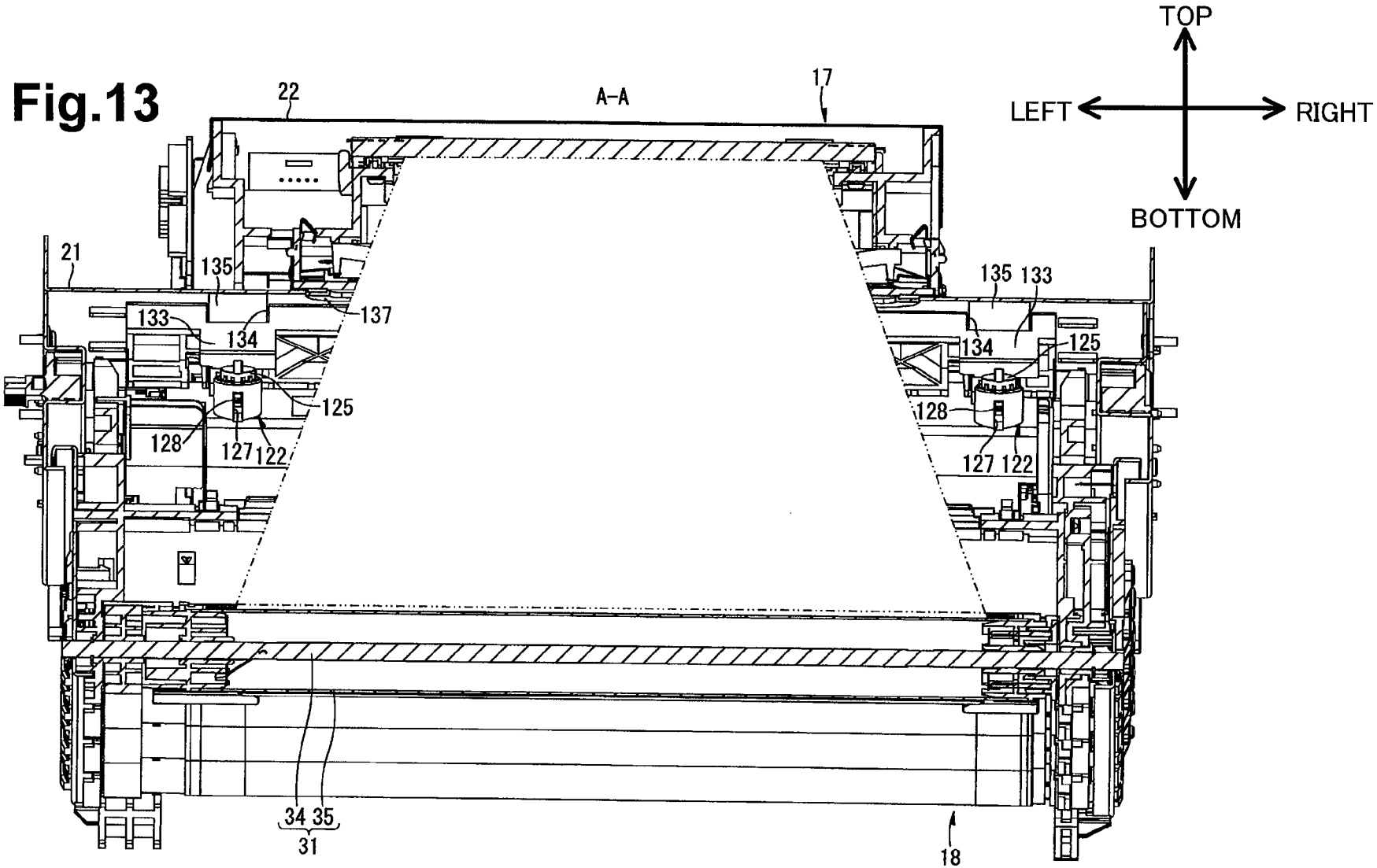
FIG. 13 is a sectional view taken along line A-A shown in FIG. 12 viewed from the front side.

In FIG. 13 showing a sectional view taken along line A-A shown in FIG. 12, a solid white area enclosed by double dotted lines represents an area where the laser beam travels from the exposure unit 17 to the photosensitive drum 31. The area becomes broader in the left and right direction as is closer to the photosensitive drum 31. A beam passing window 137 is disposed on the bottom surface of the support plate 21 of the exposure unit 17. The length of the beam passing window 137 in the left and right direction is shorter than the length of the drum body 35 in the left and right direction and shorter than the length of the rubber roller 44 in the left and right direction, which is substantially same length as the drum body 35. Therefore, the distance between the rollers 135 is wider than the length of the beam passing window 137. Therefore, when the process unit 18 is moved between the installation position and the withdrawal position, a movement path of the rollers 135 may not overlap the area of the beam passing window 137.

A contact/separation mechanism 91 for making the developing roller 39 contact to or separate from the corresponding photosensitive drum 31 will be described with reference to FIGS. 14-18.

Figure 14:
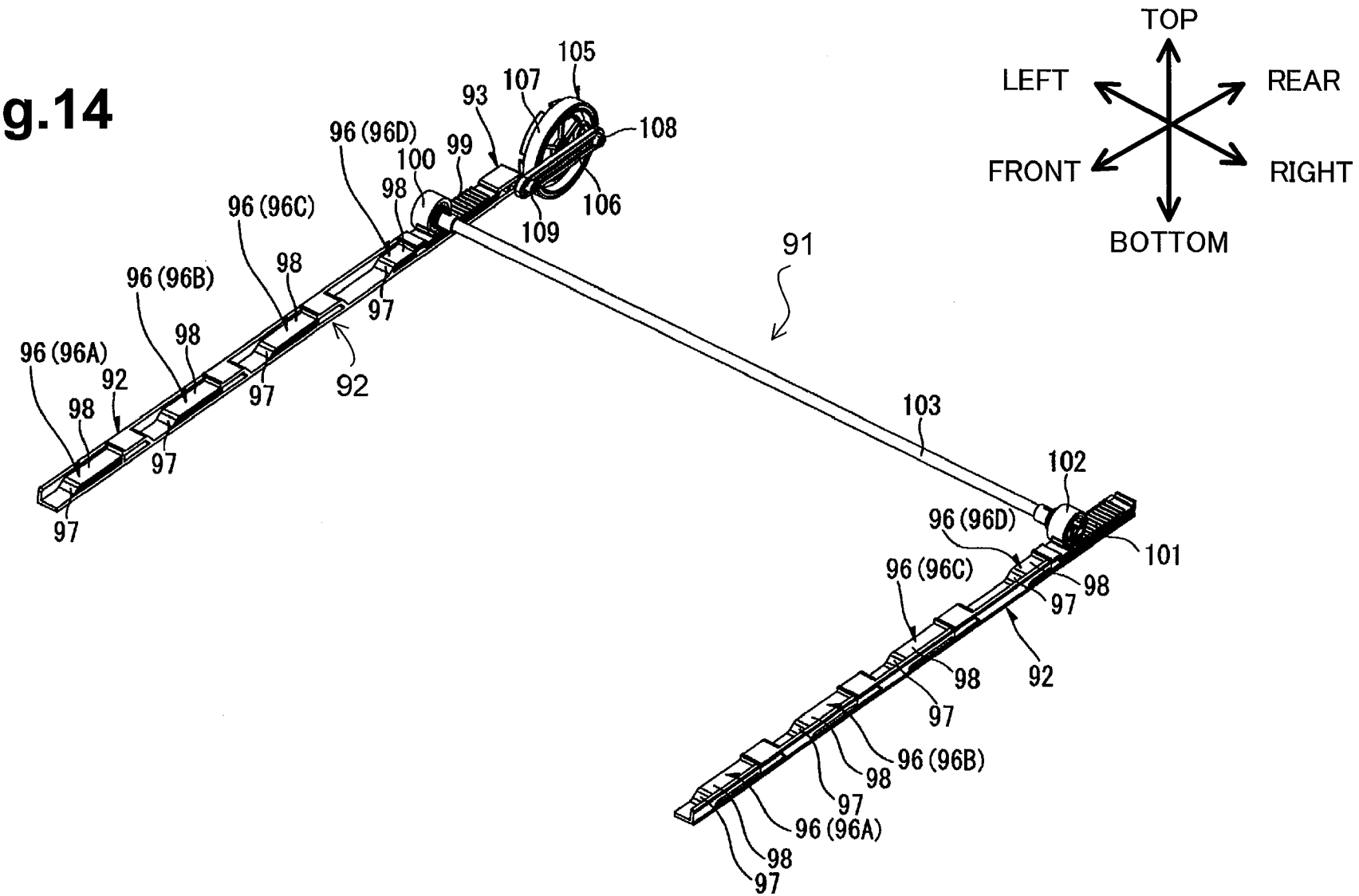
FIG. 14 is a perspective view of a contact/separation mechanism provided in the color laser printer shown in FIG. 1 viewed from an upper front right side.

As shown in FIG. 14, the contact/separation mechanism 91 of the color laser printer 1 includes a pair of linear cam members 92 and a synchronous moving mechanism 93. The linear cam members 92 are disposed so as to interpose therebetween the process unit 18 placed in the installation position. The linear cam members 92 are configured to move linearly in the front-rear direction. The synchronous moving mechanism 93 is configured to linearly move the linear cam members 92 in synchronization with each other.

Figure 15:
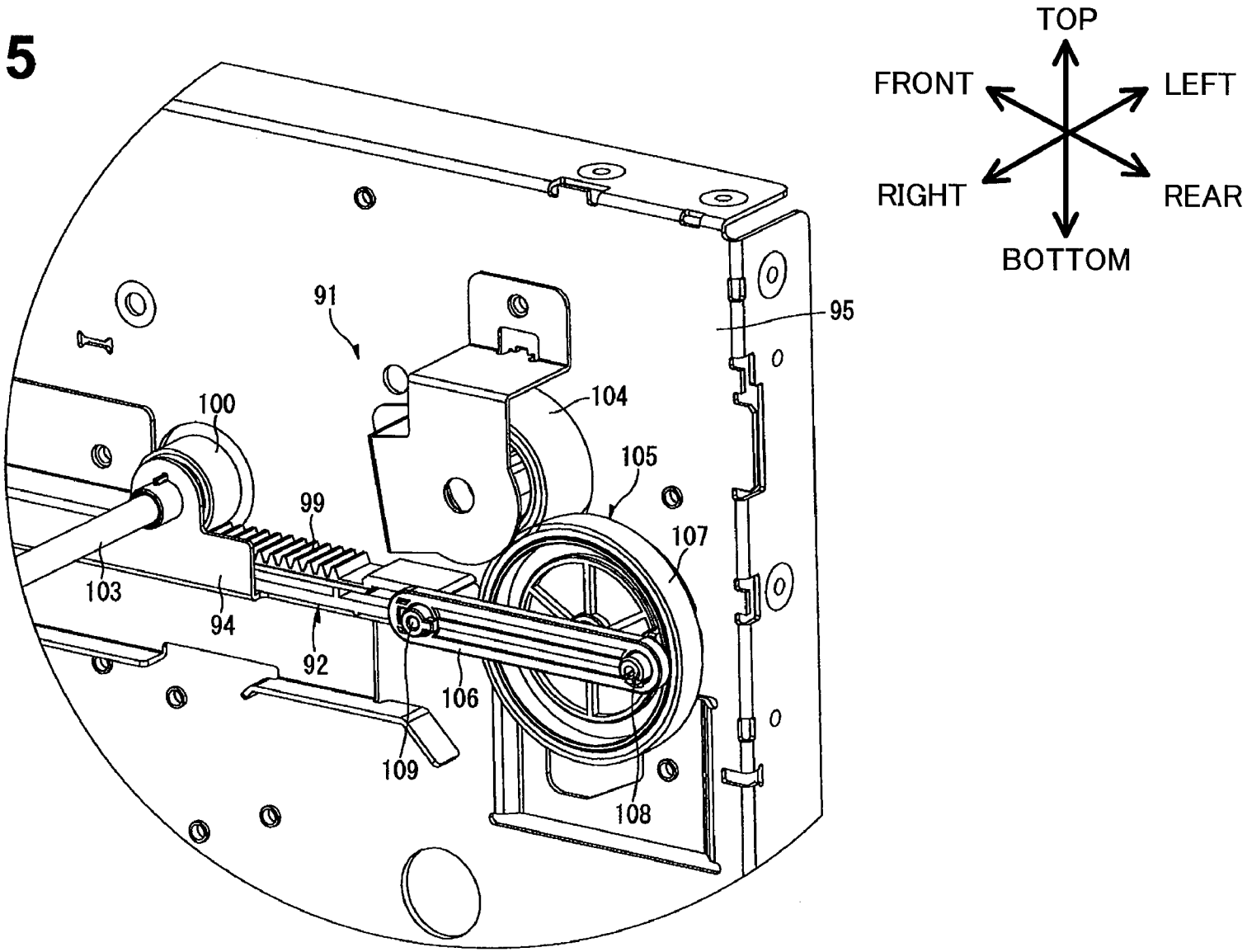
FIG. 15 is a perspective view of a rear end of the contact/separation member shown in FIG. 14 viewed from a rear right side.

Each linear cam member 92 is of a substantially plate shape elongated in the front-rear direction. As shown in FIG. 15, each linear cam member 92 is slidably held by a substantially L-shaped holder 94 in a cross section that extends in the front-rear direction. Each holder 94 (only left holder 94 shown in FIG. 15) is fixed on an inner surface of one of a pair of frames 95 (only left frame 95 shown in FIG. 15). The frames 95 are disposed within the housing 2 opposite to each other in the left and right direction. The linear cam members 92 contact protrusions 82 (FIG. 4), which extend from the sidewalls 71, from underneath when the process unit 18 is placed in the installation position.

As shown in FIG. 14, each linear cam member 92 includes cam portions 96 of a substantially trapezoidal shape in a side view. Four cam portions 96 are provided on an upper surface of each linear cam member 92 in association with the protrusions 82. Each cam portion 96 includes a slide surface 97 provided at an angle from the lower front side to the upper rear side, and a flat separation surface 98 that extends rearward from a rear end of the slide surface 97 in parallel with an upper surface of the linear cam member 92.

Figure 16:
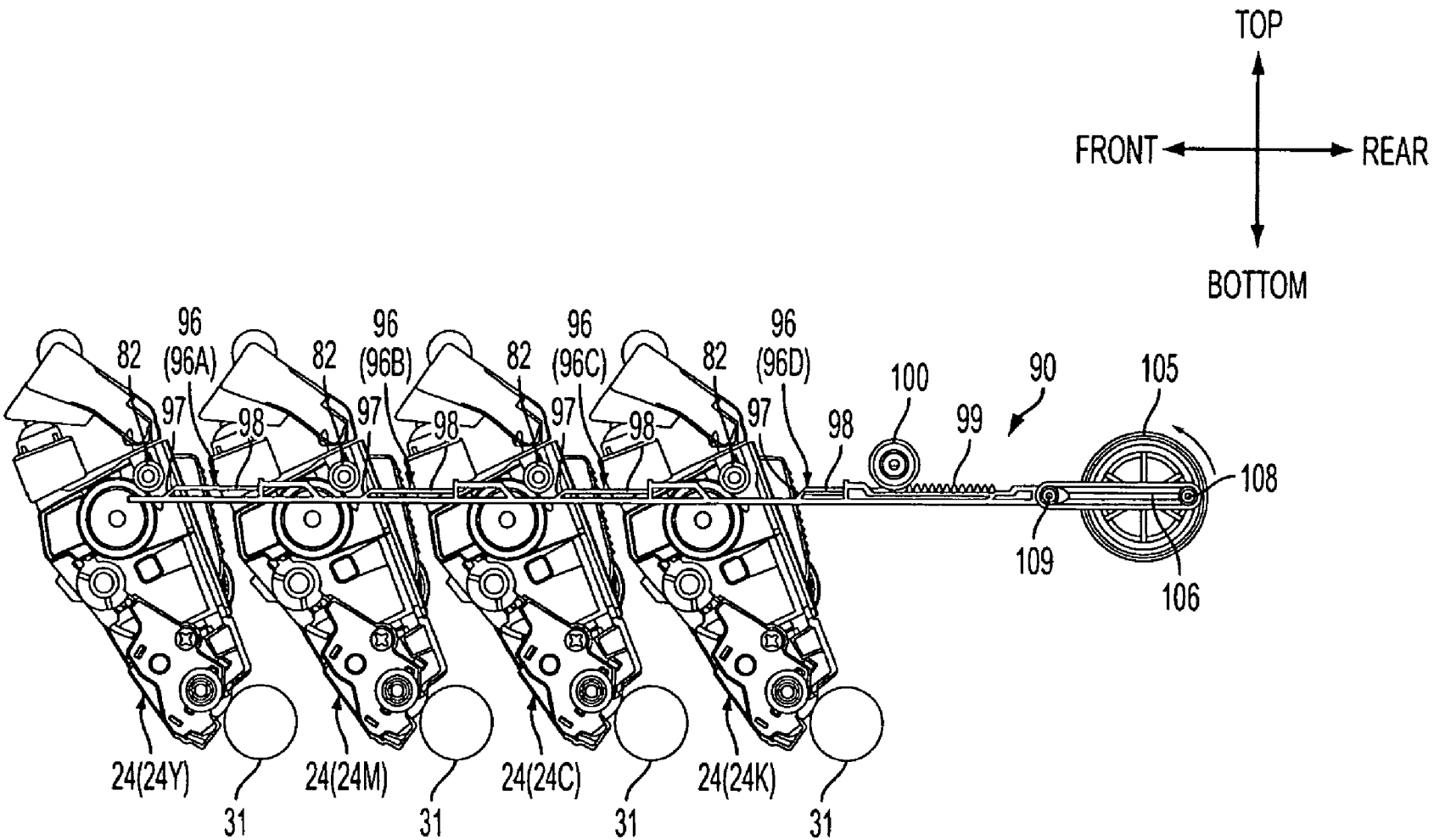
FIG. 16 is a right side view of the developing cartridges shown in FIG. 3 and the contact/separation member shown in FIG. 14, illustrating four developing cartridges being pressed against corresponding photosensitive drums.
Figure 17:
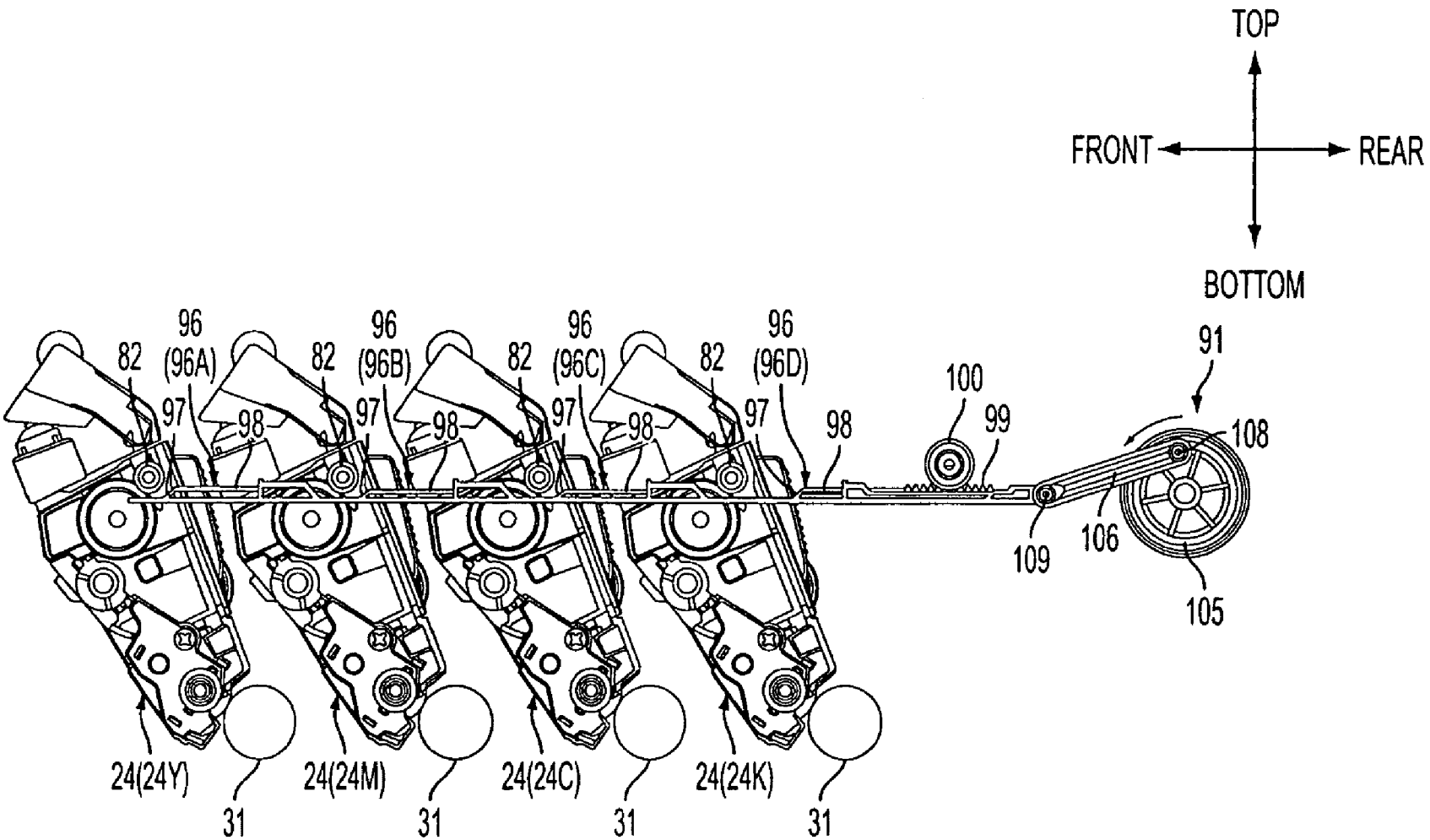
FIG. 17 is a right side view of the developing cartridges shown in FIG. 3 and the contact/separation member shown in FIG. 14, illustrating three developing cartridges being separated from the corresponding photosensitive drums and one developing cartridge being pressed against the corresponding photosensitive drum.
Figure 18:
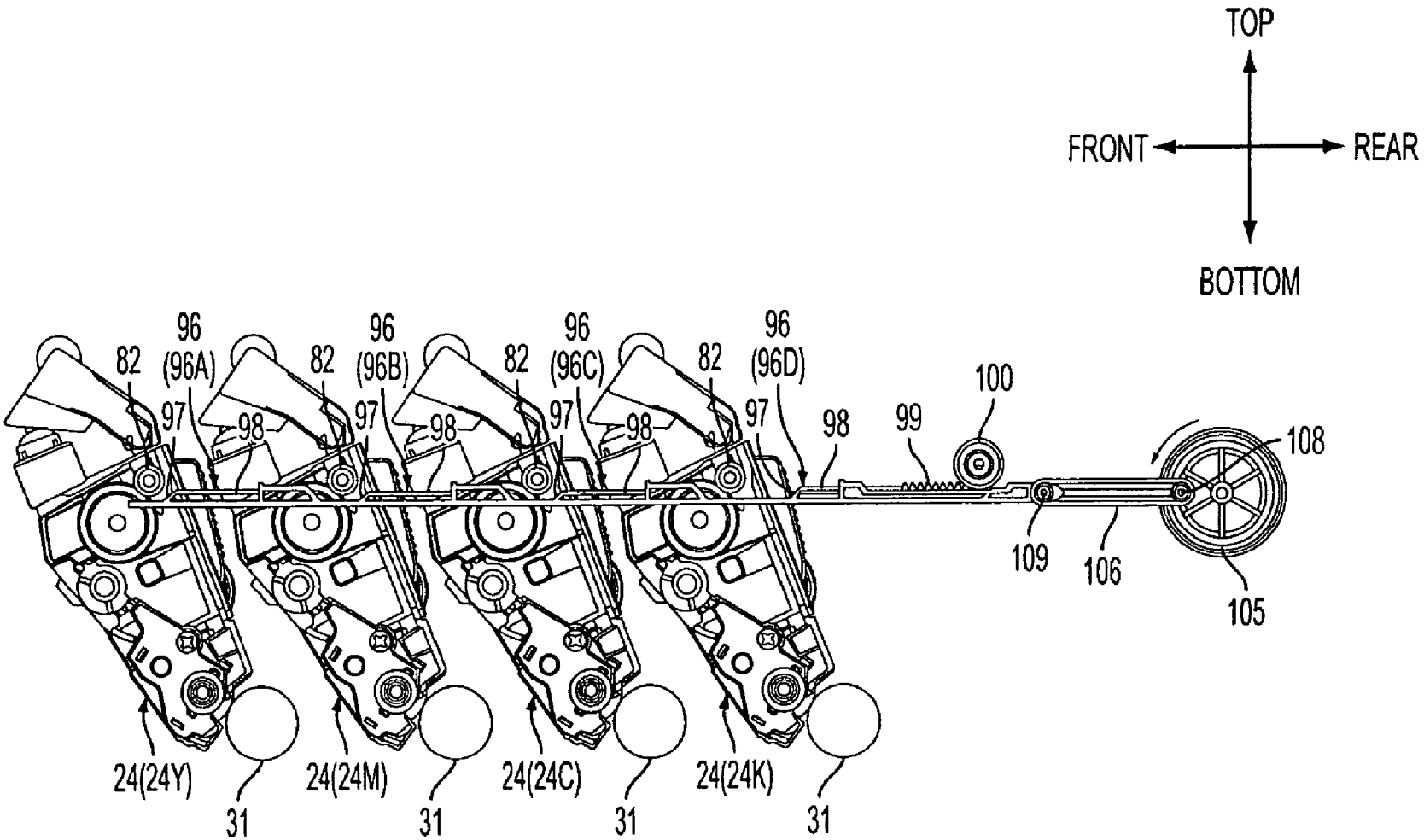
FIG. 18 is a right side view of the developing cartridges shown in FIG. 3 and the contact/separation member shown in FIG. 14, illustrating four developing cartridges being separated from the corresponding photosensitive drums.

In association with the positions of the linear cam members 92, the four cam portions 96 take states as shown in FIGS. 16-18, i.e., a state where all protrusions 82 are positioned in the front of the corresponding cam portions 96 as shown in FIG. 16; a state where the protrusion 82 of the black developing cartridge 24K is positioned in the front of the corresponding cam portion 96 and other protrusions 82 are disposed on the corresponding cam portions 96 as shown in FIG. 17; and a state where all protrusions 82 are disposed on the corresponding cam portions 96 as shown in FIG. 18. It should be noted that the urging mechanism 121 is not shown in FIG. 16-18.

More specifically, the first three cam portions 96A, 96B, 96C from the front side are formed into substantially the same shape. Also, cam portions 96A and 96C are disposed equidistantly from cam portion 96B. The distance between the last (rearmost) cam portion 96D and the third cam portion 96C is greater than a distance between the cam portion 96B and each of the other cam portions 96A and 96C. The rearmost cam portion 96D has a separation surface 98 shorter that a separation surface 98 of the other three cam portions 96A, 96B, 96C in the front-rear direction.

The synchronous moving mechanism 93 is configured to transmit drive force from the left linear cam member 92 to the right linear cam member 92 as the left linear cam member 92 linearly moves.

More specifically, as shown in FIGS. 14 and 15, the synchronous moving mechanism 93 includes a left rack gear 99, a left pinion gear 100, a right rack gear 101, a right pinion gear 102, a connecting shaft 103, a transmission gear 104, a crank gear 105, and a conversion member 106. The left rack gear 99 is formed on an upper rear surface of the left linear cam member 92. The left pinion gear 100 is configured to engage with the left rack gear 99. The right rack gear 101 is formed on an upper rear surface of the right linear cam member 92. The right pinion gear 102 is configured to engage with the right rack gear 101. The connecting shaft 103 is mounted to the left pinion gear 100 and to the right pinion gear 102 on each end thereof such that the left pinion gear 100 and the right pinion gear 102 do not rotate relative to the shaft 103. The transmission gear 104 is fixed on the left frame 95 and is configured to transmit drive force from a motor (not shown). The crank gear 105 is rotated in one direction (e.g., in the counterclockwise direction in FIG. 15) with the rotating force of the transmission gear 104. The conversion member 106 is configured to convert the rotation of the crank gear 105 into linear movement for the left linear cam member 92.

The left pinion gear 100 and the right pinion gear 102 engage with the left rack gear 99 and the right rack gear 101, respectively, at their front ends when the linear cam members 92 are moved to the rearmost positions, as shown in FIG. 16. When the linear cam members 92 are moved to the foremost positions as shown in FIG. 18, the left pinion gear 100 and the right pinion gear 102 engage with the left rack gear 99 and the right rack gear 101, respectively, at their rear ends.

The connecting shaft 103 is disposed between the holders 94, and rotatably supported by the holders 94, as shown in FIG. 15.

The crank gear 105 is rotatably supported by a central shaft, which extends in the left and right direction and is supported by the frame 95. A gear 107 that engages with the transmission gear 104 is formed on the perimeter of the crank gear 105. The crank gear 105 is provided with a rear-side protruding shaft 108 that protrudes toward the right side.

The rearmost end of the left linear cam member 92 is provided with a front-side protruding shaft 109 that protrudes toward the right side. When the linear cam member 92 is in the rearmost position or the foremost position, as shown in FIGS. 16 and 18, the front-side protruding shaft 109 faces the rear-side protruding shaft 108 in the front-rear direction in parallel with each other.

The conversion member 106 is disposed between the rear-side protruding shaft 108 and the front-side protruding shaft 109, such that an end of the conversion member 106 moves along a movement path of the rear-side protruding shaft 108 when the crank gear 105 is rotated.

As shown in FIG. 16, when the linear cam members 92 are moved to the rearmost position, each protrusion 82 of the developing cartridges 24 is placed in front of the corresponding cam portion 96, and contacts an upper surface of the linear cam members 92. The developing roller 39 of each developing cartridge 24 is pressed against the corresponding photosensitive drum 31 with the elastic force (restoring force) of the coil springs 126 of the elastic mechanisms 122.

As the transmission gear 104 is rotated by drive force from the motor (not shown) in the state as shown in FIG. 16, the crank gear 105 is rotated counterclockwise in FIG. 16. Accordingly, the rear-side protruding shaft 108 moves frontward, and the left linear cam member 92 moves frontward. With the movement of the left linear cam member 92, the left pinion gear 100 rotates clockwise in FIG. 16, and the rotation of the left pinion gear 100 is transmitted to the right pinion gear 102 via the connecting shaft 103. The right pinion gear 102 rotates in the same direction as the left pinion gear 100, and consequently, the right linear cam member 92 moves frontward.

As shown in FIG. 17, when the crank gear 105 rotates approximately 90 degrees from the state shown in FIG. 16, the protrusions 82 of the yellow, magenta and cyan developing cartridges 24Y, 24M, 24C slide on the sliding surfaces 97 of the corresponding cam portions 96 and are raised on the separation surfaces 98 of the corresponding cam portions 96. The protrusions 82 of the black developing cartridge 24K are positioned in the front of the corresponding cam portions 96. Thus, the yellow developing cartridge 24Y, the magenta developing cartridge 24M, and the cyan developing cartridge 24C are moved upward, and their developing rollers 39 separate from the corresponding photosensitive drums 31. In this instance, only the developing roller 39 of the black developing cartridge 24K maintains contact with the corresponding photosensitive drum 31.

As shown in FIG. 18, when the crank gear 105 is rotated counterclockwise approximately 180 degrees from the state shown in FIG. 16, by driving the motor, the linear cam members 92 are moved to the foremost position, the protrusions 82 of all developing cartridges 24 are raised on the separation surfaces 98 of the corresponding cam portions 96. Thus, all the developing cartridges 24 are moved up and the developing rollers 39 of the developing cartridges 24 separate from the corresponding photosensitive drums 31.

When the motor is further driven to rotate the crank gear 105 counterclockwise in FIG. 18, the rear-side protruding shaft 108 is moved rearward and accordingly the pair of linear cam members 92 is moved rearward. When the crank gear 105 is rotated 180 degrees from the state shown in FIG. 18, all the developing cartridges 24 are placed in the state shown in FIG. 16 where the developing rollers 39 are pressed against the corresponding photosensitive drums 31.

As described above, each developing cartridge 24 has the urging mechanism 121. Every time the developing cartridge 24 is replaced, the urging mechanism 121 may be also replaced. The urging mechanism 121 may be used in a condition where the elastic force of the urging mechanism 121 is properly maintained. Thus, favorable pressing of the developing roller 39 against the corresponding photosensitive drum 31 may be continued. Accordingly, the amount of toner to be supplied to the photosensitive drum 31 may be properly maintained and a quality image may be produced continuously.

For example, when specifications of the toner or the developing roller 39 are changed, the urging mechanism 121 may be employed that has elasticity that meets the specification changes. Thus, the pressing force of the developing roller 39 against the corresponding photosensitive drum 31 may be properly controlled to ensure the appropriate toner supply from the developing roller 39 to the corresponding photosensitive drum 31. Accordingly, an electrostatic latent image formed on the photosensitive drum 31 may be made visible or developed favorably, leading to quality image formation.

When the process unit 18 is moved from the withdrawal position to the installation position, the pressing member 123 is placed between the elastic mechanisms 122 and the bottom surface of the support plate 21 of the exposure unit 17. The pressing member 123 presses the elastic mechanisms 122 down. With the elastic force (restoring force) of the elastic mechanisms 122, the developing roller 39 may be pressed against the corresponding photosensitive drum 31. Thus, an additional device to press the developing roller 39 against the corresponding photosensitive drum 31 may not be required, reducing costs and the number of components to be used.

By the pivotal movement of the pressing member 123, the pressing member 123 may be made to make contact with or to be separated from the elastic mechanisms 122. As the pressing member 123 is pivotally moved toward the elastic mechanisms 122 after the pressing member 123 contacts the elastic mechanisms 122, the pressing member 123 may reliably press the elastic mechanisms 122 down.

The pressing member 123 is pivotable. Therefore, even if an obstacle exists on the movement path of the pressing member 123 placed in the upright state when the process unit 18 is installed in the housing 2, the pressing member 123 comes into contact or collides with the obstacle, so that the pressing member 123 may be pivotally moved and placed in the contact state. Therefore, the pressing member 123 may not hinder the installation of the process unit 18. Thus, the process unit 18 may be smoothly installed in the housing 2.

The elastic mechanism 122 is disposed at two positions with some distance therebetween in the axial direction of the developing roller 39. With the elasticity of the coil spring 126 of each elastic mechanism 122, the developing roller 39 may be pressed against the corresponding photosensitive drum 31 in a well-balanced manner in the axial direction of the roller 39, through the case 36. Thus, toner may be supplied from the developing roller 39 to the corresponding photosensitive drum 31 uniformly in the axial direction of the drum 31. Consequently, an electrostatic latent image formed on the photosensitive drum 31 may be made visible or developed favorably.

Each elastic mechanism 122 faces an edge of the rubber roller 44 in a direction perpendicular to the axial direction of the roller 44. With the elasticity of the coil spring 126 of each elastic mechanism 122, the edges of the developing roller 39 may be reliably pressed against the photosensitive drum 31. Accordingly, the developing roller 39 may be pressed against the photosensitive drum 31 across the length of the roller 39 in its axial direction. Thus, toner may be supplied from the developing roller 39 to the photosensitive drum 31 uniformly in the axial direction of the drum 31. Consequently, an electrostatic latent image formed on the photosensitive drum 31 may be made visible or developed favorably.

The elastic deformation of the coil spring 126 is guided by the corresponding spring guide member 124, so that the coil spring 126 may elastically deform while its posture is maintained stably by the guide member 124. Therefore, the developing roller 39 may be favorably urged toward the photosensitive drum 31.

The pressing member 123 is provided with the rollers 135. When the process unit 18 is moved between the withdrawal position and the installation position, the rollers 135 rotate, so that the process unit 18 may be smoothly moved. Thus, the pressing member 123 and the support plate 21 may not be rubbed together. Accordingly, wear or abrasion of the pressing member 123 may be prevented.

The length of the beam passing window 137 in the left and right direction is shorter than the length of the drum body 35 in the left and right direction and shorter than the length of the rubber roller 44 in the left and right direction. Therefore, when the process unit 18 is moved between the installation position and the withdrawal position, the rollers 135 may not pass the area of the beam passing window 137. Consequently, the beam passing window 137 may not be contaminated, so that a quality image may be formed.

The pressing member 123 also functions as a handle of the developing cartridge 24. While holding the pressing member 123, a user may move the developing cartridge 24 or removably install the developing cartridge 24 in the drum unit 23. Therefore, operability of the developing cartridge 24 may be improved without increasing the number of components to be used for the cartridge 24.

Another aspect of the invention will be described with reference to FIGS. 19-24. It should be noted that like numerals denote like components and the detailed description thereof with respect to FIGS. 19-24 will be omitted.

A developing cartridge 224 includes an urging mechanism 141 for urging the developing roller 39 toward the corresponding photosensitive drum 31. The urging mechanism 141 is different from the urging mechanism 121, shown in FIGS. 3-8, of the developing cartridge 24.

The urging mechanism 141 includes elastic mechanisms 142, a cylindrical protrusion 143 and a pressing member 144. The elastic mechanisms 142 are disposed outside each sidewall 71, so as to face each other. The protrusion 143 protrudes toward the right side from the bearing member 80. The pressing member 144 presses the elastic mechanisms 142 at one time between the gear positioning portion 78 and the protrusion 143. The gear positioning portion 78 and the protrusion 143 may be examples of protrusions.

Figure 21:
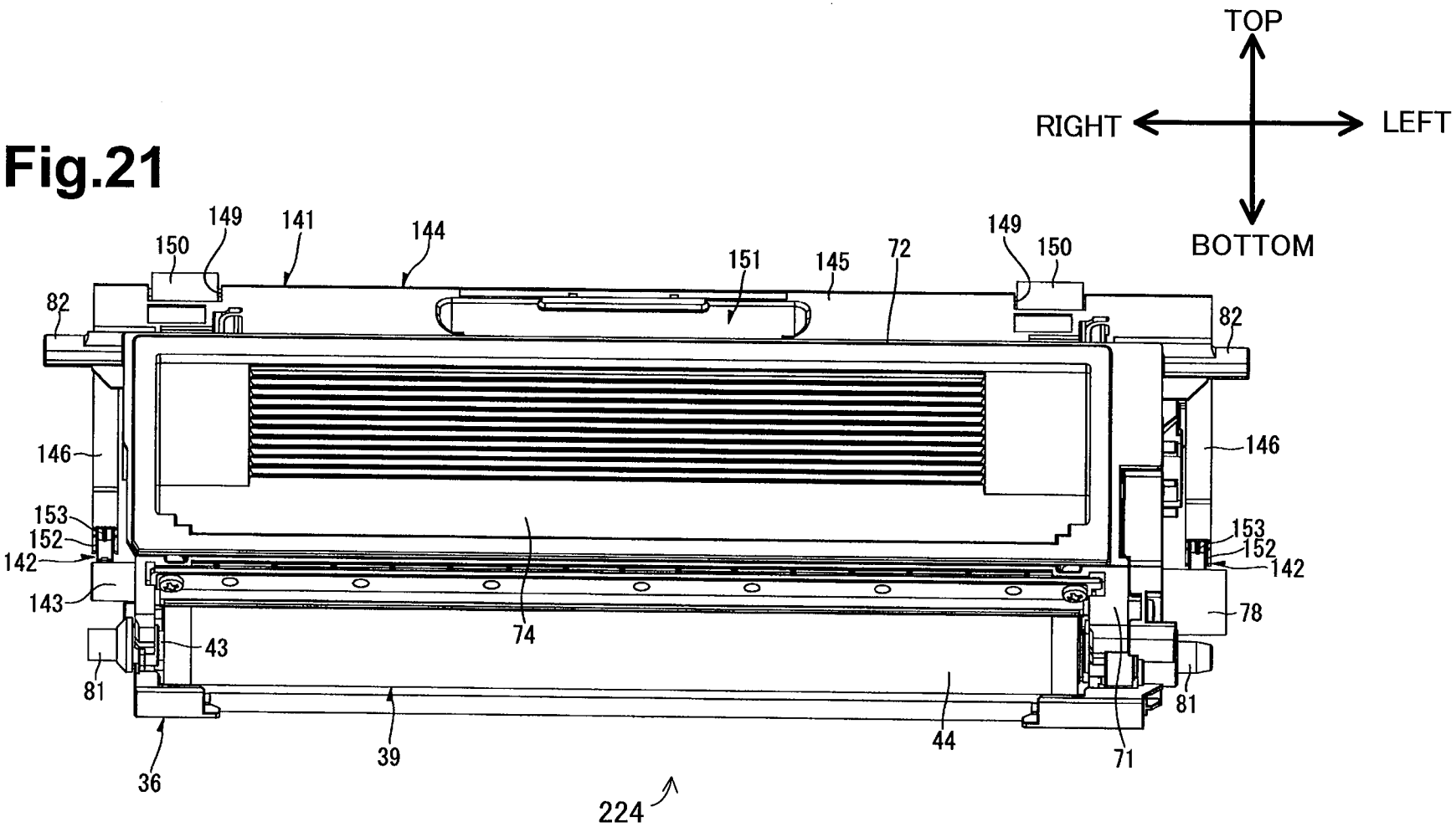
FIG. 21 is a rear side view of the developing cartridge shown in FIG. 19.

As shown in FIG. 21, the protrusion 143 is disposed opposite to the gear positioning portion 78 in the left and right direction.

The pressing member 144 includes a thin-plate-like main body 145 elongated in the left and right direction and an operation part 146 extending from each of the left and right ends of the main body 145 along the left and right sidewalls 71, respectively in parallel with the corresponding sidewalls 71.

Figure 19:
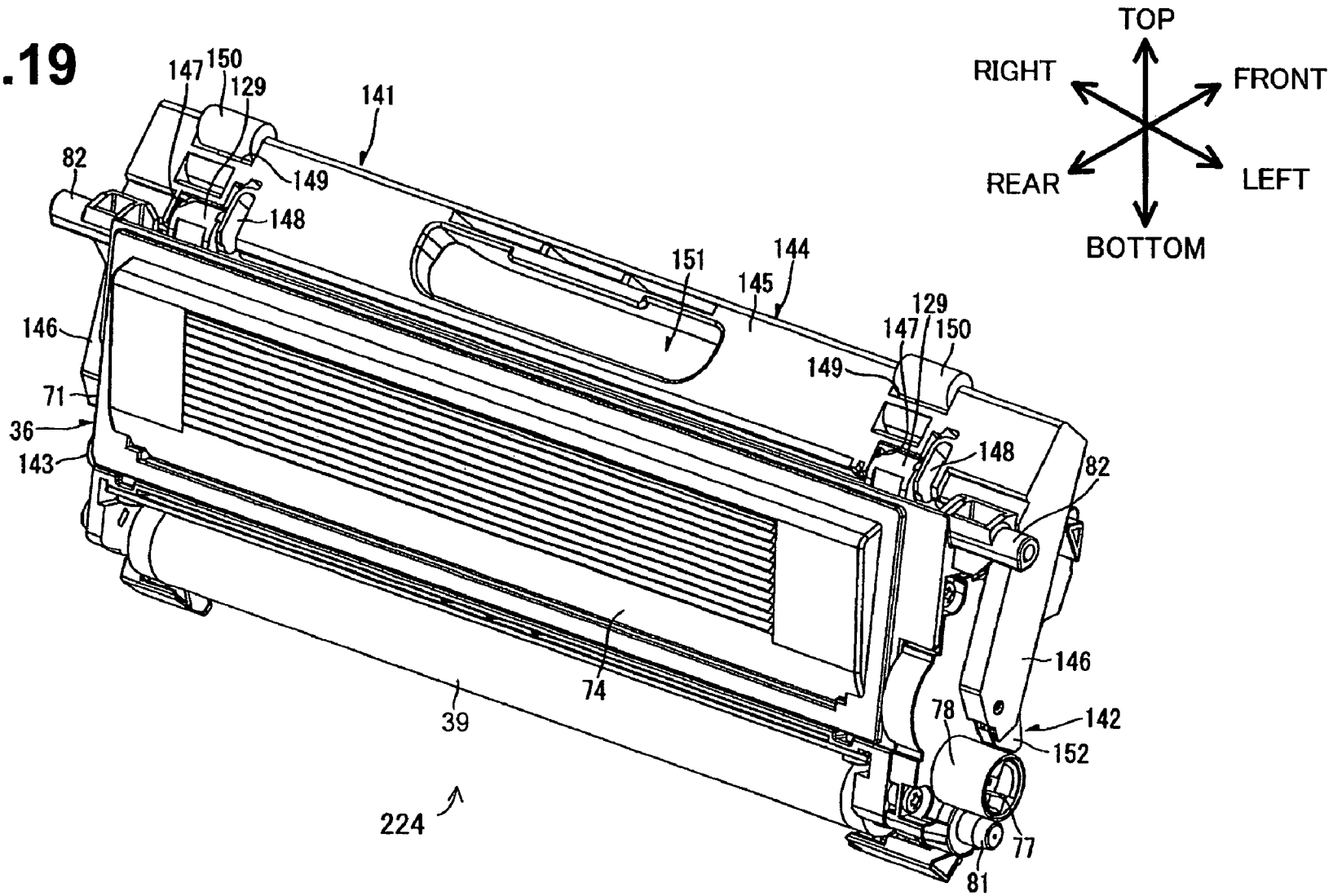
FIG. 19 is a perspective view of a developing cartridge according to another aspect viewed from a rear left side.
Figure 20:
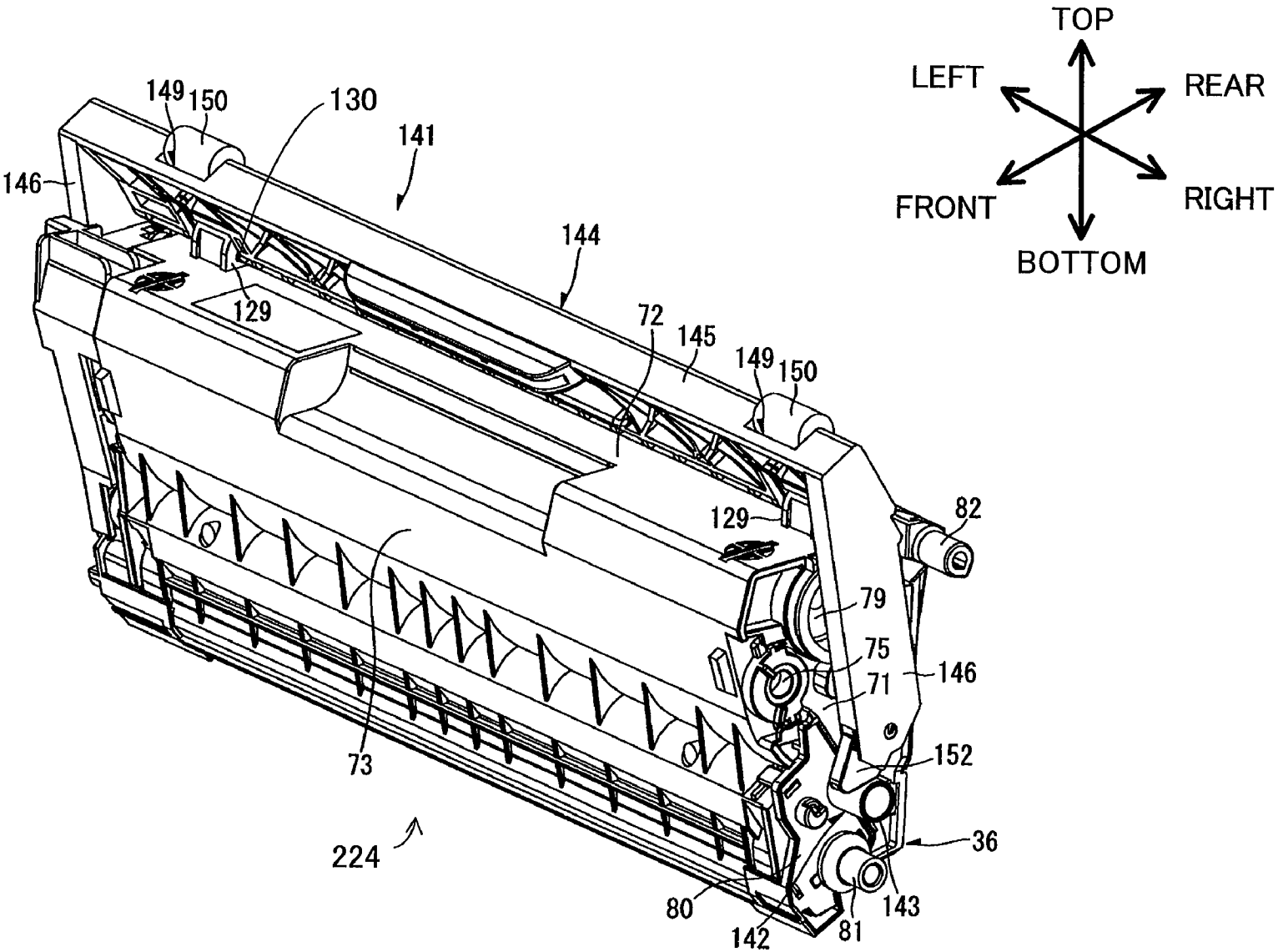
FIG. 20 is a perspective view of the developing cartridge shown in FIG. 19 viewed from a front right side.

As shown in FIG. 19, an engagement portion 147 is disposed at rear left and right ends of the main body 145. An elastic piece 148, which is shaped into a substantially "L" shape in a plan view, is disposed on a left side surface of each engagement portion 147. A distal end of the elastic piece 148 is connected to the left side surface of the engagement portion 147. A free end of the elastic piece 148 faces the right side surface of the corresponding engagement portion 147 with a space therebetween. A support shaft (not shown) extends from the free end of each elastic piece 148 and the right side surface of the corresponding engagement portion 147 so as to face each other.

As the elastic piece 148 is deformed, the distance between the support shafts expands. In this state, each pressing member support portion 129 is fitted in the space between the free end of the elastic piece 148 and the right side surface of the engagement portion 147. Then, as the deformed elastic piece 148 is restored to its original state, each support shaft is fitted into the corresponding support hole 130. Thus, the pressing member 144 is pivotally attached to the pressing member support portions 129.

Roller receiving portions 149 are disposed on the front end of the main body 145. The roller receiving portions 149 are disposed with a distance substantially equal to the length of the rubber roller 44 between the roller receiving portions 149. The roller receiving portion 149 is disposed to face an edge of the rubber roller 44 in the direction perpendicular to the axial direction of the rubber roller 44. Each roller receiving portion 149 is of a substantially rectangular shape in top and front views.

A roller 150 of a substantially cylindrical shape is rotatably disposed in each roller receiving portion 149. Accordingly, the distance between the rollers 150 is substantially the same as the length of the rubber roller 44. The rollers 150 function as friction reduction members when the rollers 150 contact the bottom surface of the support plate 21.

When the process unit 18 is moved from the withdrawal position to the installation position, the rollers 150 contact the bottom surface of the support plate 21. The bottom surface of the support plate 21 presses the rollers 150 down.

As shown in FIG. 19, an opening 151 is provided in a substantially central portion of the main body 145 in the left and right direction. The opening 151 is of a substantially rectangular shape in a plan view that is elongated in the left and right direction. A user may hold the main body 145 of the pressing member 144 by inserting his/her fingers into the opening 151. The pressing member 144 may be used as a handle or grip.

Figure 22:
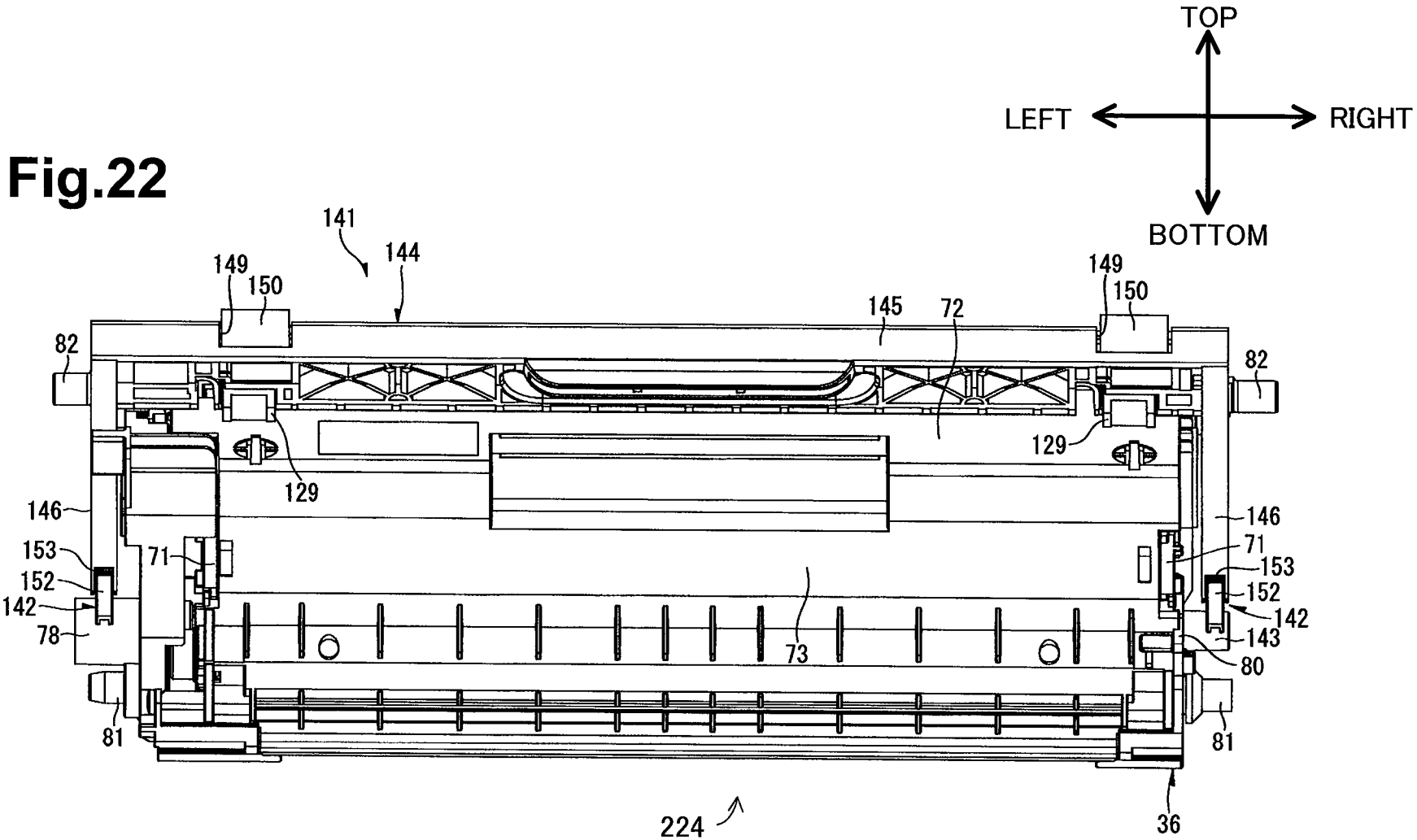
FIG. 22 is a front side view of the developing cartridge shown in FIG. 19.
Figure 23:
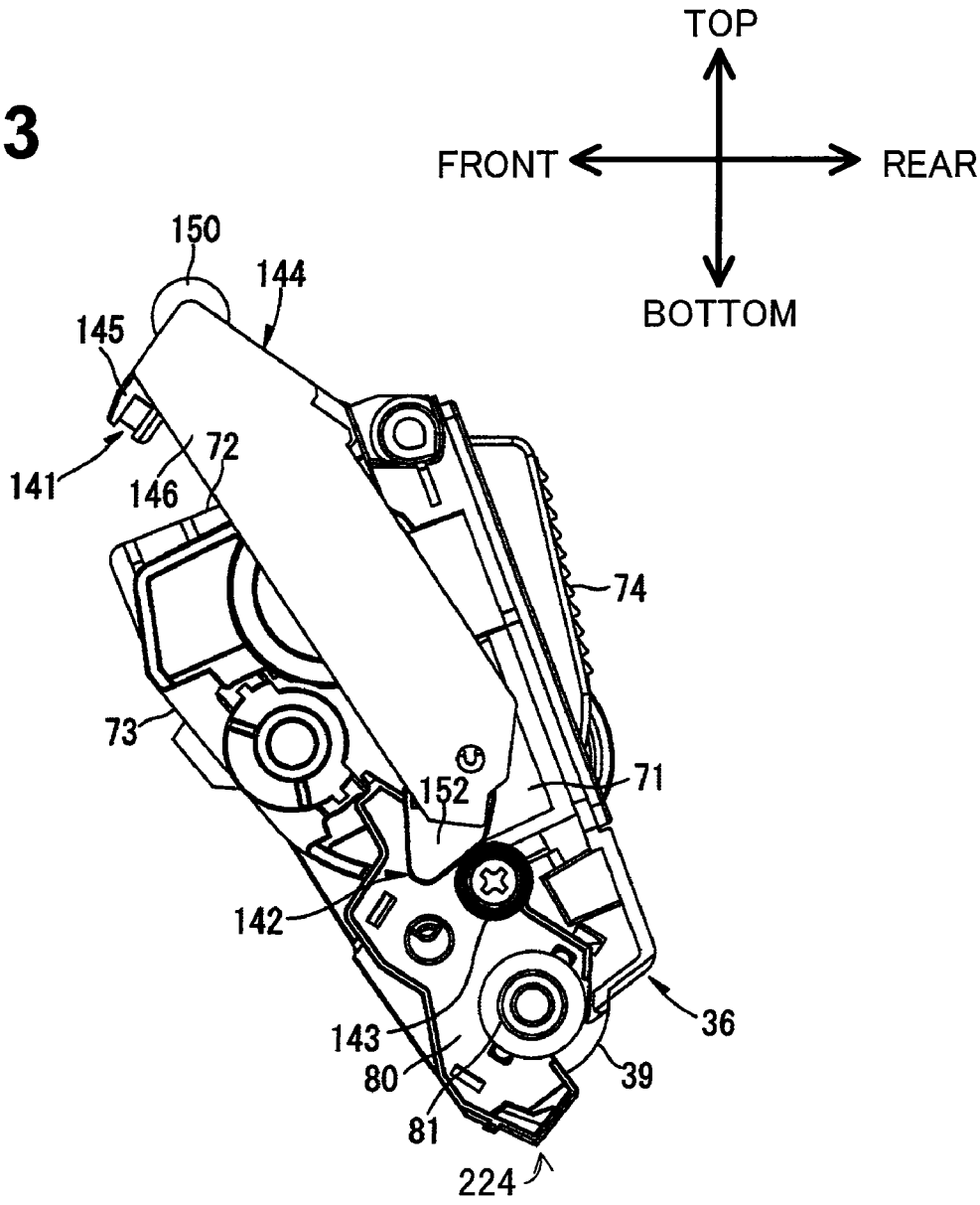
FIG. 23 is a right side view of the developing cartridge shown in FIG. 19.
Figure 24:
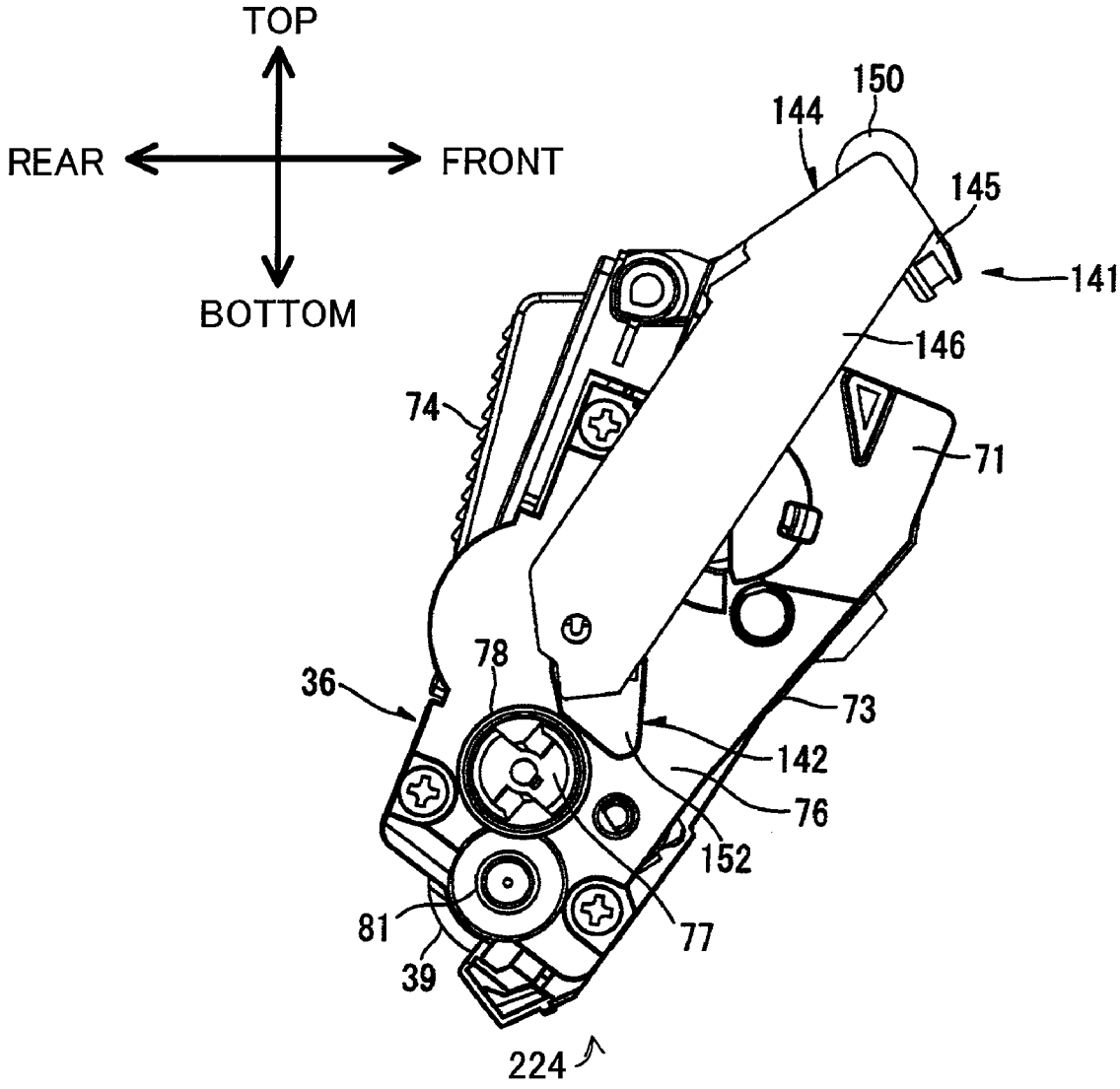
FIG. 24 is a left side view of the developing cartridge shown in FIG. 19.

Each elastic mechanism 142 is connected to a lower end of one of the right and left operation parts 146 of the pressing member 144. As shown in FIGS. 21 and 22, each elastic mechanism 142 includes a contact member 152 as an example of a guide member, and a coil spring 153 as an example of an elastic member. The contact member 152 is fitted in the lower end of the operation part 146. The contact member 152 is configured to advance or retract from the operation part 146. The coil spring 153 is disposed inside the contact member 152. The coil spring 153 is configured to urge the contact member 152 in a direction to advance from the operation part 146.

It is required that the contact members 152 of the left and right elastic mechanisms 142 do not contact the gear positioning portion 78 and the protrusion 143, respectively when a user pivotally moves the main body 145 about the pressing member support portions 129 up to a position substantially perpendicular to the top wall 72. Therefore, the operation parts 146 are designed to be of a length such that the left and right contact members 152 do not contact the gear positioning portion 78 and the protrusion 143, respectively when the main body 145 is placed substantially perpendicular to the top wall 72.

When the user releases his/her hand from the main body 145, the main body 145 tilts toward a direction to approach the top wall 72. Accordingly, the left and right contact members 152 contact the gear positioning portion 78 and the protrusion 143, respectively.

In this state, as the main body 145 is pushed down, each contact member 152 is pushed toward inside the corresponding operation part 146, and each coil spring 153 is compressed. As the left coil spring 153 is compressed, its restoring force is applied to the gear positioning portion 78 and the operation part 146. As the right coil spring 153 is compressed, its restoring force is applied to the protrusion 143 and the operation part 146. Consequently, the case 36 is urged downward and the developing roller 39 is pressed against the drum 31.

When the process unit 18 is moved from the withdrawal position to the installation position, the rollers 150 are pressed down by the bottom surface of the support plate 21, so that the coil springs 153 may be compressed. With the restoring force of the coil springs 153, the developing roller 39 may be pressed against the corresponding photosensitive drum 31.

Thus, the developing cartridge 224 shown in FIGS. 19-24 may achieve effects similar to the developing cartridge 24 shown in FIG. 3-8.

While the invention has been described in connection with various example structures and illustrative aspects, it will be understood by those skilled in the art that other variations and modifications of the structures and aspects described above may be made without departing from the scope of the invention. Other structures and aspects will be apparent to those skilled in the art from a consideration of the specification or practice of the invention disclosed herein. It is intended that the specification and the described examples are illustrative with the true scope of the invention being defined by the following claims.

What is claimed is:

1. An image forming apparatus comprising:

a housing;

an image carrier unit configured to move along a first direction between a first position and a second position in the housing, the image carrier unit configured to hold a plurality of image carriers;

a plurality of developing cartridges configured to be removably mounted in the image carrier unit; and an exposure unit disposed in the housing, the exposure unit being configured to generate light to irradiate each of the image carriers;

wherein each developing cartridge includes:

a developer carrier configured to supply developer to the image carrier;

a case configured to contain the developer, the case having a support portion for supporting the developer carrier at a first side of the case, the case including a pair of sidewalls facing each other in a second direction perpendicular to the first direction; and a handle disposed at a second side of the case opposite to the first side, the handle being configured to directly contact the exposure unit when the image carrier unit is in the first position.

2. The image forming apparatus according to claim 1, wherein the developing cartridge includes at least one elastic member configured to face the exposure unit when the image carrier unit is in the first position, wherein the handle includes a pressing member configured to press the at least one elastic member while being placed between the exposure unit and the at least one elastic member when the image carrier unit is in the first position.

3. The image forming apparatus according to claim 2, wherein two elastic members are spaced apart from each other in the axial direction of the developer carrier.

4. The image forming apparatus according to claim 3, wherein each elastic member is disposed to face the edge of the developer carrier in a direction perpendicular to the axial direction of the developer carrier.

5. The image forming apparatus according to claim 1, wherein the developer cartridge includes:

elastic members, each elastic member disposed outside one of the sidewalls of the case; and protrusions, each protrusion configured to extend outward from one of the sidewalls in an axial direction of the developer carrier, wherein the handle includes a pressing member configured to press each elastic member against one of the protrusions when the image carrier unit is in the first position.

6. The image forming apparatus according to claim 5, wherein each elastic member is provided in one of the sidewalls of the case.

7. The image forming apparatus according to claim 2, wherein the at least one elastic member includes a spring.

8. The image forming apparatus according to claim 2, further including a guide member configured to guide the at least one elastic member when the at least one elastic member is pressed by the pressing member.

9. The image forming apparatus according to claim 2, wherein the pressing member includes a contact portion configured to contact the exposure unit when the developing cartridge is installed in the image forming apparatus, the contact portion being disposed to face an edge of the developer carrier in a direction perpendicular to an axial direction of the developer carrier.

10. The image forming apparatus according to claim 9, wherein the contact portion includes a friction reduction member configured to reduce friction between the exposure unit and the contact portion.

11. The image forming apparatus according to claim 10, wherein the friction reduction member includes a roller.

12. The image forming apparatus according to claim 2, wherein the pressing member is configured to pivot about an axis extending along an axial direction of the developer carrier, so as to make contact with or separate from the at least one elastic member.

13. The image forming apparatus according to claim 12, wherein the pressing member is configured to move between an upright state where the pressing member is substantially perpendicular to the first direction and a tilted state where the pressing member is tilted upstream of the first direction.

14. The image forming apparatus according to claim 2, wherein the handle includes an opening.

15. A developing cartridge configured to be installed in an image forming apparatus including an image carrier and an exposure unit, comprising:

a developer carrier configured to supply developer to the image carrier;

a case configured to contain the developer, the case having a support portion for supporting the developer carrier at a first side of the case, the case including a pair of sidewalls facing each other; and a handle disposed at a second side of the case opposite to the first side, the handle being configured to directly contact the exposure unit when the developing cartridge is installed in the image forming apparatus.

16. The developing cartridge according to claim 15, further comprising at least one elastic member configured to face the exposure unit when the developing cartridge is installed in the image forming apparatus, wherein the handle includes a pressing member configured to press the at least one elastic member while being placed between the exposure unit and the at least one elastic member when the developing cartridge is installed in the image forming apparatus.

17. The developing cartridge according to claim 16, wherein two elastic members are spaced apart from each other in the axial direction of the developer carrier.

18. The developing cartridge according to claim 17, wherein each elastic member is disposed to face the edge of the developer carrier in a direction perpendicular to the axial direction of the developer carrier.

19. The developing cartridge according to claim 15, further comprising:

elastic members, each elastic member disposed outside one of the sidewalls of the case; and protrusions, each protrusion configured to extend outward from one of the sidewalls in an axial direction of the developer carrier, wherein the handle includes a pressing member configured to press each elastic member against one of the protrusions when the developing cartridge is installed in the image forming apparatus.

20. The developing cartridge according to claim 19, wherein each elastic member is provided in one of the sidewalls of the case.

21. The developing cartridge according to claim 16, wherein the at least one elastic member includes a spring.

22. The developing cartridge according to claim 16, further including a guide member configured to guide the at least one elastic member when the at least one elastic member is pressed by the pressing member.

23. The developing cartridge according to claim 16, wherein the pressing member includes a contact portion configured to contact the exposure unit when the developing cartridge is installed in the image forming apparatus, the contact portion being disposed to face an edge of the developer carrier in a direction perpendicular to an axial direction of the developer carrier.

24. The developing cartridge according to claim 23, wherein the contact portion includes a friction reduction member configured to reduce friction between the exposure unit and the contact portion.

25. The developing cartridge according to claim 24, wherein the friction reduction member includes a roller.

26. The developing cartridge according to claim 16, wherein the pressing member is configured to pivot about an axis extending along the axial direction of the developer carrier, so as to make contact with or separate from the at least one elastic member.

27. The developing cartridge according to claim 26, wherein the pressing member is configured to pivot between an upright state and a tilted state.

28. The developing cartridge according to claim 16, wherein the handle has an opening.

* * * * *